US008480327B2

(12) United States Patent
Horn

(10) Patent No.: US 8,480,327 B2
(45) Date of Patent: Jul. 9, 2013

(54) BINDER APPARATUS

(76) Inventor: Hans Johann Horn, Bern (CH)

( * ) Notice: Subject to any disclaimer, the term of this patent is extended or adjusted under 35 U.S.C. 154(b) by 0 days.

(21) Appl. No.: 13/184,314

(22) Filed: Jul. 15, 2011

(65) Prior Publication Data

US 2011/0318086 A1 Dec. 29, 2011

Related U.S. Application Data

(63) Continuation of application No. PCT/EP2010/050260, filed on Jan. 12, 2010.

(30) Foreign Application Priority Data

Jan. 16, 2009 (DE) ..... 10 2009 055341 U

(51) Int. Cl.
*B42F 13/20* (2006.01)
*B42F 3/02* (2006.01)
*B42F 13/30* (2006.01)

(52) U.S. Cl.
USPC ..... 402/34; 402/35; 402/55

(58) Field of Classification Search
USPC ..... 402/34, 35, 55
See application file for complete search history.

(56) References Cited

U.S. PATENT DOCUMENTS

| | | | |
|---|---|---|---|
| 683,019 | A | 9/1901 | Buchanan |
| 692,584 | A | 2/1902 | Adams |
| 724,849 | A | 4/1903 | Gresham |
| 763,176 | A | 6/1904 | Gresham et al. |
| 778,992 | A | 1/1905 | Nelson |
| 792,389 | A | 6/1905 | Boehner |
| 812,397 | A | 2/1906 | Boehner |
| 840,949 | A | 1/1907 | Mendenhall |
| 842,851 | A | 2/1907 | Boden |
| 857,377 | A | 6/1907 | Baker |

(Continued)

FOREIGN PATENT DOCUMENTS

| | | |
|---|---|---|
| EP | 1829706 | 9/2007 |
| FR | 1336765 | 9/1963 |
| FR | 1346864 | 12/1963 |
| FR | 2221924 | 10/1974 |
| FR | 2238332 | 2/1975 |
| GB | 868724 | 5/1961 |
| GB | 906279 | 9/1962 |
| GB | 952536 | 3/1964 |
| GB | 2292343 | 2/1996 |
| GB | 2359784 | 9/2001 |
| GB | 2387815 | 10/2003 |
| JP | 5979379 | 5/1984 |
| JP | 1299095 | 12/1989 |
| JP | 2034289 | 2/1990 |
| JP | 6118880 | 4/1994 |
| WO | 01/66363 | 9/2001 |
| WO | 2005035265 | 4/2005 |

OTHER PUBLICATIONS

Patent Cooperation Treaty, International Search Report, issued by the International Searching Authority in connection with related PCT application No. PCT/EP2010/050260, mailed Jul. 14, 2010 (2 pages).

Patent Cooperation Treaty, Written Opinion of the International Searching Authority, issued by the International Searching Authority in connection with related PCT application No. PCT/EP2010/050260, mailed Jul. 14, 2010 (14 pages).

*Primary Examiner* — Dana Ross
*Assistant Examiner* — Kyle Grabowski
(74) *Attorney, Agent, or Firm* — Hanley, Flight and Zimmerman, LLC

(57) ABSTRACT

Binder apparatus are described. An example binder apparatus includes a housing, a first support rail positioned within the housing and a second support rail positioned within the housing. The binder apparatus also includes first and second closure members coupled to the respective support rails. The closure members are positioned on the respective support rails to enable locking elements of the closure members to interlock when the binder apparatus is in a closed position. The binder apparatus also includes a lever comprising tabs that are received by recesses defined by the support rails. An interaction between the tabs and the support rails enables the support rails to be moved relative to one another and the locking elements to be moved to an unlocked position.

19 Claims, 20 Drawing Sheets

U.S. PATENT DOCUMENTS 901,076 A 10/1908 Dawson
904,618 A 11/1908 Kellner
936,448 A 10/1909 Hamacher
968,657 A 8/1910 Hamacher et al.
974,831 A 11/1910 Scherzinger
1,020,561 A 3/1912 Krumming
1,105,196 A 7/1914 Hanke
1,163,179 A 12/1915 Schade, Jr.
1,165,766 A 12/1915 Elder
1,231,816 A 7/1917 Vesterling
1,331,226 A 2/1920 Adams
1,398,034 A 11/1921 Mero
1,398,388 A 11/1921 Murphy
1,398,540 A 11/1921 Day
1,402,018 A 1/1922 Schade
1,473,354 A 11/1923 Nachtrieb
1,548,748 A 8/1925 Riley
1,610,985 A 12/1926 Vea
1,733,548 A 10/1929 Martin
1,733,894 A 10/1929 Martin
1,765,353 A 6/1930 Myers
1,787,957 A 1/1931 Schade
1,797,447 A 3/1931 Savidge
1,816,021 A 7/1931 Meyerson
1,919,784 A 7/1933 Freiberg
1,932,874 A 10/1933 Adams
1,991,362 A 2/1935 Krag
1,996,463 A 4/1935 Dawson et al.
2,013,416 A 9/1935 McClure
2,020,129 A 11/1935 Wedge
2,024,461 A 12/1935 Lotter
2,030,473 A 2/1936 Schade
2,075,766 A 3/1937 Rand
2,077,677 A 4/1937 Dawson
2,088,431 A 7/1937 Newman
2,089,211 A 8/1937 Krag
2,096,944 A 10/1937 Unger et al.
2,104,046 A 1/1938 Krag
2,105,235 A * 1/1938 Schade ..... 402/38
2,119,639 A 6/1938 Lotter
2,158,056 A 5/1939 Cruzan
2,179,627 A 11/1939 Handler
2,204,918 A 6/1940 Trussell
2,218,105 A 10/1940 Griffin
2,236,321 A 3/1941 Ostrander
2,239,121 A 4/1941 St. Louis et al.
2,252,422 A 8/1941 Unger
2,260,929 A 10/1941 Bloore
2,268,431 A 12/1941 Slonneger
2,288,189 A 6/1942 Guinane
2,304,716 A 12/1942 Supin
2,311,492 A 2/1943 Unger
2,311,620 A 2/1943 Murphy
2,322,595 A 6/1943 Schade
2,389,115 A 11/1945 Anderson
2,421,799 A 6/1947 Martin
2,460,718 A 2/1949 Stevens
2,528,866 A 11/1950 Dawson, Jr.
2,543,866 A 3/1951 Panfil, Sr.
2,548,618 A 4/1951 Purvis
2,612,169 A 9/1952 Segal
2,645,227 A 7/1953 Segal
2,664,897 A 1/1954 Derringer
2,711,555 A 6/1955 Hanson
2,715,906 A 8/1955 Lucchesi
2,865,377 A 12/1958 Schroer et al.
2,871,711 A 2/1959 Stark
2,891,553 A 6/1959 Acton
3,077,888 A 2/1963 Thieme
3,098,489 A 7/1963 Vernon
3,098,490 A 7/1963 Wance
3,104,667 A 9/1963 Mintz
3,135,266 A 6/1964 Bouhier
3,149,636 A 9/1964 Rankin
3,190,293 A 6/1965 Schneider et al.
3,205,894 A 9/1965 Rankin
3,205,895 A 9/1965 Johnson
3,246,653 A 4/1966 Sexton
3,253,842 A 5/1966 Rabe
3,255,759 A * 6/1966 Dennis ..... 402/34
3,331,373 A 7/1967 Lohmeier
3,348,550 A 10/1967 Wolf et al.
3,718,402 A 2/1973 Schade
3,728,036 A 4/1973 Cott
3,748,051 A 7/1973 Frank
3,827,111 A 8/1974 O'Connell
3,833,308 A 9/1974 Seaborn
3,884,586 A 5/1975 Michaelis et al.
3,954,343 A 5/1976 Thomsen
3,993,374 A 11/1976 Schudy et al.
4,127,340 A 11/1978 Almgren
4,130,368 A 12/1978 Jacoby et al.
4,308,637 A 1/1982 Kucera
4,352,582 A 10/1982 Eliasson
4,415,290 A 11/1983 Ohminato
4,486,112 A 12/1984 Cummins
4,522,526 A 6/1985 Lozfau
4,551,118 A 11/1985 Spisz
4,566,817 A 1/1986 Barrett, Jr.
4,571,108 A 2/1986 Vogl
4,607,970 A 8/1986 Heusinkveld
4,624,595 A 11/1986 Ohminato
4,678,357 A 7/1987 Kissel et al.
4,690,580 A 9/1987 Kissel
4,696,595 A 9/1987 Pinkney
4,798,491 A 1/1989 Lassle
4,813,803 A 3/1989 Gross
4,815,882 A 3/1989 Ohminato
4,830,528 A 5/1989 Handler
4,886,390 A 12/1989 Silence
4,904,103 A 2/1990 Lm
4,919,557 A 4/1990 Podosek
D317,177 S 5/1991 Wandemberg-Boschetti
5,018,896 A 5/1991 Vanni
5,116,157 A 5/1992 Gillum et al.
5,180,247 A 1/1993 Yu
5,201,101 A 4/1993 Rouser
5,255,991 A 10/1993 Sparkes
5,286,128 A 2/1994 Gillum
5,354,142 A 10/1994 Yu
5,368,407 A 11/1994 Law
5,393,156 A 2/1995 Mullin et al.
5,476,335 A 12/1995 Whaley
5,660,490 A 8/1997 Warrington
5,692,847 A 12/1997 Zane et al.
5,692,848 A 12/1997 Wada
5,697,722 A 12/1997 Hladik et al.
5,718,529 A 2/1998 Chan
5,765,956 A 6/1998 Lanzarin
5,782,569 A 7/1998 Mullin et al.
5,807,006 A 9/1998 Cheung
5,810,499 A 9/1998 Law
5,827,004 A 10/1998 Kim
5,868,513 A 2/1999 Law
5,895,164 A 4/1999 Wu
5,938,365 A 8/1999 Grewe
5,950,341 A 9/1999 Cross
5,975,784 A 11/1999 Whaley
5,975,785 A 11/1999 Chan
6,036,394 A 3/2000 Cheng
D430,204 S 8/2000 Berracasa
6,109,813 A 8/2000 To
6,155,737 A 12/2000 Whaley
6,179,508 B1 1/2001 Coerver
6,203,229 B1 3/2001 Coerver
6,206,601 B1 3/2001 Ko
6,217,247 B1 4/2001 Ng
6,270,279 B1 8/2001 Whaley
6,270,280 B1 8/2001 Baumann
6,276,862 B1 8/2001 Snyder
6,293,722 B1 * 9/2001 Holbrook et al. ..... 402/35
6,328,497 B1 12/2001 To
6,364,558 B1 4/2002 To
6,467,984 B1 10/2002 To
6,749,357 B2 6/2004 Cheng
6,761,497 B2 7/2004 Kaneda
6,840,695 B2 1/2005 Horn D533,588 S 12/2006 Cheng
7,275,886 B2 10/2007 Cheng
7,293,932 B2 11/2007 Wong
7,296,946 B2 11/2007 Cheng et al.
7,360,962 B2 4/2008 To
7,600,939 B2 10/2009 Liu et al.
2003/0044221 A1 3/2003 To et al.
2003/0103798 A1 6/2003 Cheng et al.
2003/0123923 A1 7/2003 Koike et al.
2004/0013463 A1 1/2004 To
2004/0086323 A1* 5/2004 Tanaka et al. ..... 402/35
2005/0013654 A1 1/2005 Cheng
2005/0207826 A1 9/2005 Cheng
2005/0232689 A1 10/2005 Cheng
2005/0271459 A1 12/2005 To
2006/0153628 A1 7/2006 Tanaka et al.
2006/0153629 A1* 7/2006 Cheng ..... 402/35
2008/0080925 A1 4/2008 Cheng
2008/0080926 A1* 4/2008 Liu et al. ..... 402/35
2009/0274509 A1 11/2009 Liu et al.
2010/0034576 A1* 2/2010 Tanaka et al. ..... 402/34
2012/0020721 A1* 1/2012 Lin ..... 402/35

* cited by examiner 16
30
24
25
34
42'
16
19
42"
22
20
16
19
18
16'
32'
19'
30
32
20'
19'
16'
14
42
24
16
19'
16'
19
25
24
20
19
22
30
19
18
32
32'
16'
19'
25
16
14
16'
20'
24
16
25
20
19
22
30
19
18
32
32'
16'
19'

16'
18
12'
10
32'
32
16

32, 32'
14

14
16
20
58
60
18

18
44
46
60
50
14
20'

20
20'
34
22
32'
16
32
16'

20
16'
16
56
54
18

18
44
46
60
50
16'
16
20'

20
34
22
32'
16
32
16'

16
20
16'
56
58
54
60
18

18
46
60
50
16'
16
20'

20
42
25
34
30
25
32'
16
32
16'

60
12
10
11
12'
69''
69'
28
26

63
72
62
76
67'
67''

67''
62
76
72
63

32
62
63
19'
16'
76'
67''
67'

66
30
65
1002
64
66
30

1500
32
32'
16
16'
63
74
76'
62
67'
67''
24
76
18
72
67'
67''

32
16
32'
80, 86
16'
90
94
118
92

1700
32
16
32'
80, 86
16'
10
90
118
92, 94

32
16
32'
86
80
16'
20
20'
118
94
88

16
16'
20
20'
80
86
90
94
118
88

16'
20'
84'
82'
80, 86
82
20
84
19'
118
94
16

16'
20'
84'
82'
80, 86
82
20
84
118
88
94
16

BINDER APPARATUS

RELATED APPLICATION

This patent is a continuation of International Patent Application Serial No. PCT/EP2010/050260, filed Jan. 12, 2010, which claims priority to German Patent Application 10 2009 005 341.7, filed on Jan. 16, 2009, both of which are hereby incorporated herein by reference in their entireties.

FIELD OF THE DISCLOSURE

This patent relates generally to binders and, more specifically, to binder apparatus.

BACKGROUND

Some known binder mechanisms include support rails positioned within a binder housing such that the support rails may be secured in two stable positions. The first position may correspond to a position in which the binder mechanism is in a closed position and the second position may correspond to a position in which the binder mechanism is in an open position. The binder housing may be elastic and/or spring-like to fix and/or secure half rings connected to the respective support rails in the open and/or closed positions. Entrainers and/or joint elements may be positioned between inner longitudinal edges of the support rails to ensure that the support rails abut one another obtusely at their inner longitudinal edges. The outer edges of the support rails may be resiliently held such that the support rails function as a toggle lever.

Some known binder mechanisms may also include a locking mechanism that includes one or more locking elements that secure corresponding half rings in the closed position. Securing the binder mechanism in the closed position may be brought about solely by blocking the support rails. As such, a limited amount of force urges and/or maintains the free ends of the half rings together (i.e., the ends not connected to the support rails). Some known binder mechanisms such as that described in EP 1 189 764 BZ, include a locking rod that may be actuated independently from the support rails. Locking elements that act against the support rails may be coupled to and/or associated with the locking rod.

U.S. Pat. No. 7,600,939 describes that the free ends of the half rings may include interlocking locking elements. The locking elements may interlock in the closed position, thereby preventing the pivoting of the support rails about a pivot axis. When opening such binder mechanisms, one of the support rails may be moved relative to the other support rail along a movement path to initiate and/or trigger the unlocking of the locking elements by moving the half rings from an overlapping position to an exposed position.

DETAILED DESCRIPTION

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity. Additionally, several examples have been described throughout this specification. Any features from any example may be included with, a replacement for, or otherwise combined with other features from other examples.

The examples described herein relate to example binder apparatus and/or mechanisms having an elongated housing with a C-shaped, U-shaped, etc., cross-section. The housing may include a central portion or wall and a plurality of lateral flanks or portions that are bent to form opposing longitudinal grooves. Two example elongated support rails may be positioned within the housing. Inner longitudinal edges of the support rails may abut and/or engage to form a pivot axis. Outer longitudinal edges of the support rails may be positioned within and/or engage the respective longitudinal grooves defined by the binder housing.

The example binder apparatus may also include a plurality of half rings that may be coupled at respective ends to the support rails. The half rings may be longitudinally spaced from one another along the respective support rail such that each of the half rings on a first support rail corresponds to half rings on a second support rail. The half rings form ring pairs about the exterior of the binder housing in the closed position. The support rails may be pivoted in a restricted matter against and/or relative to one another around a pivot axis and/or along a pivot path while entraining and/or moving the half rings between a closed position and an open position. The half rings may include one or more locking mechanisms that secure the ends of half rings together when the binder apparatus is positioned in the closed position.

Figures 1A, 1B, 1C:
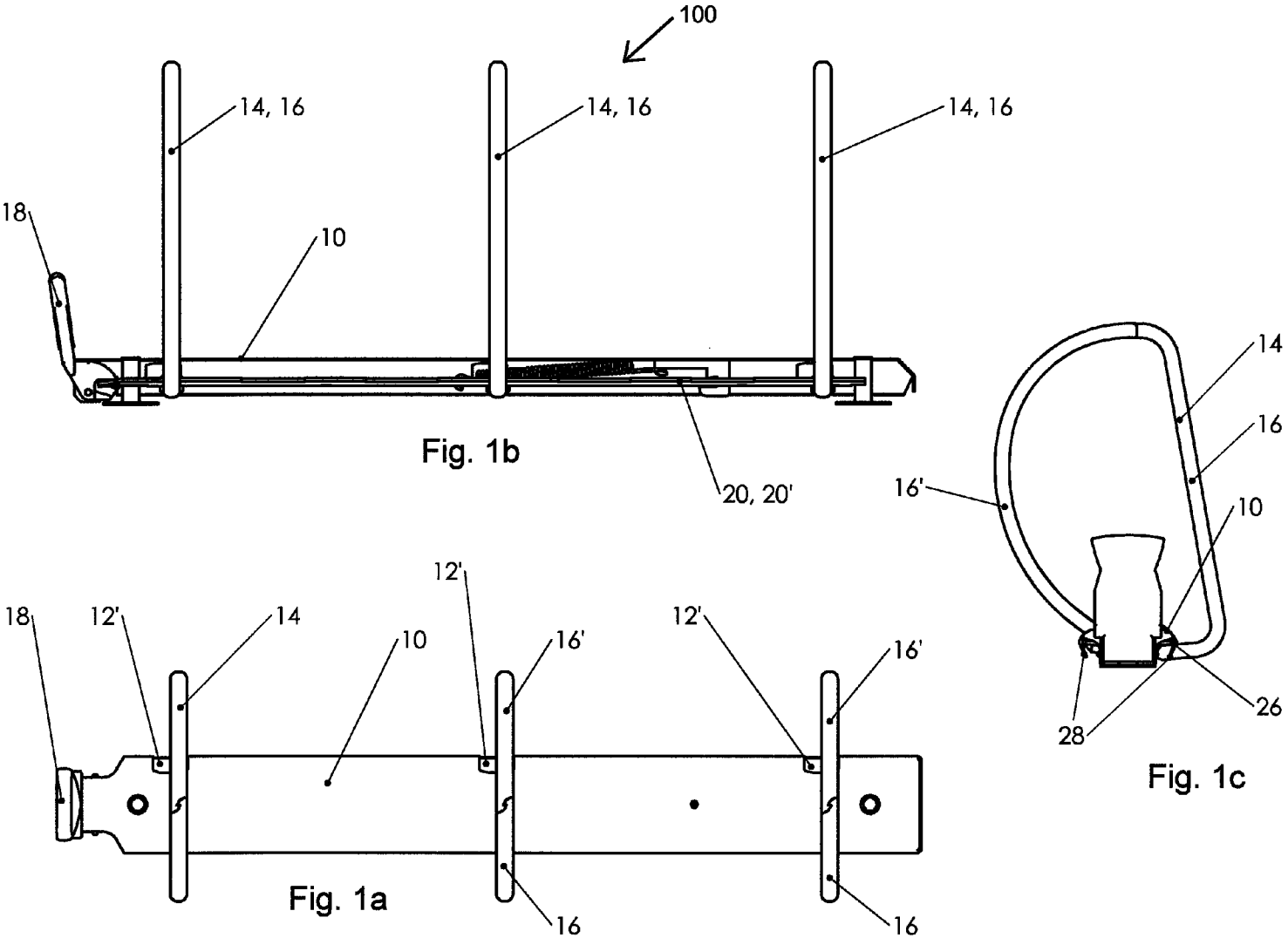
FIGS. 1*a*-1*c* depict a top view, a partial cutaway lateral view and a frontal view of an example binder apparatus.
Figures 2A, 2B:
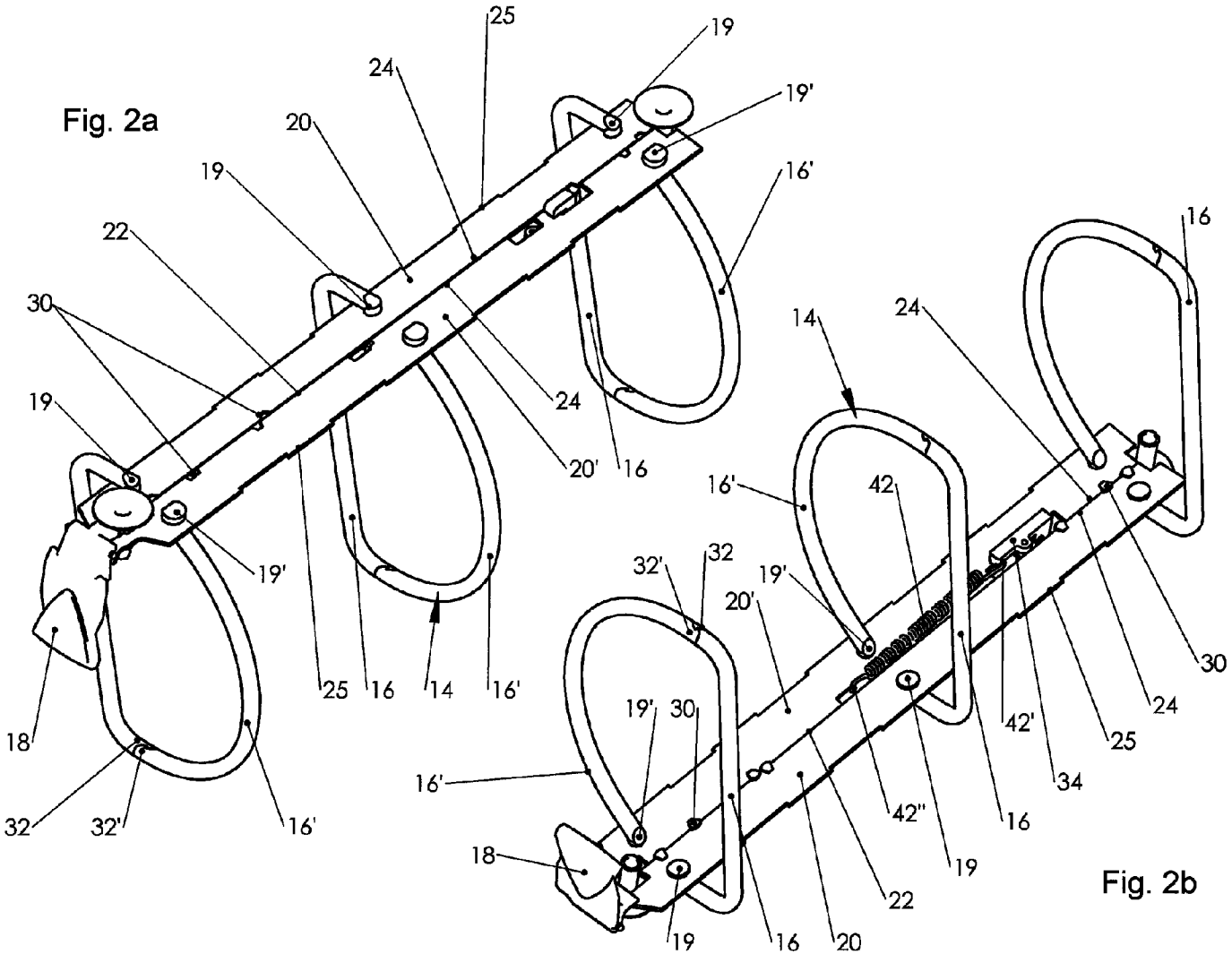
FIGS. 2*a* and 2*b* depict a bottom and top view of example half rings coupled to example support rails that may be used in connection with the example binder apparatus of FIGS. 1*a*-1*c*.
Figures 2C, 2D:
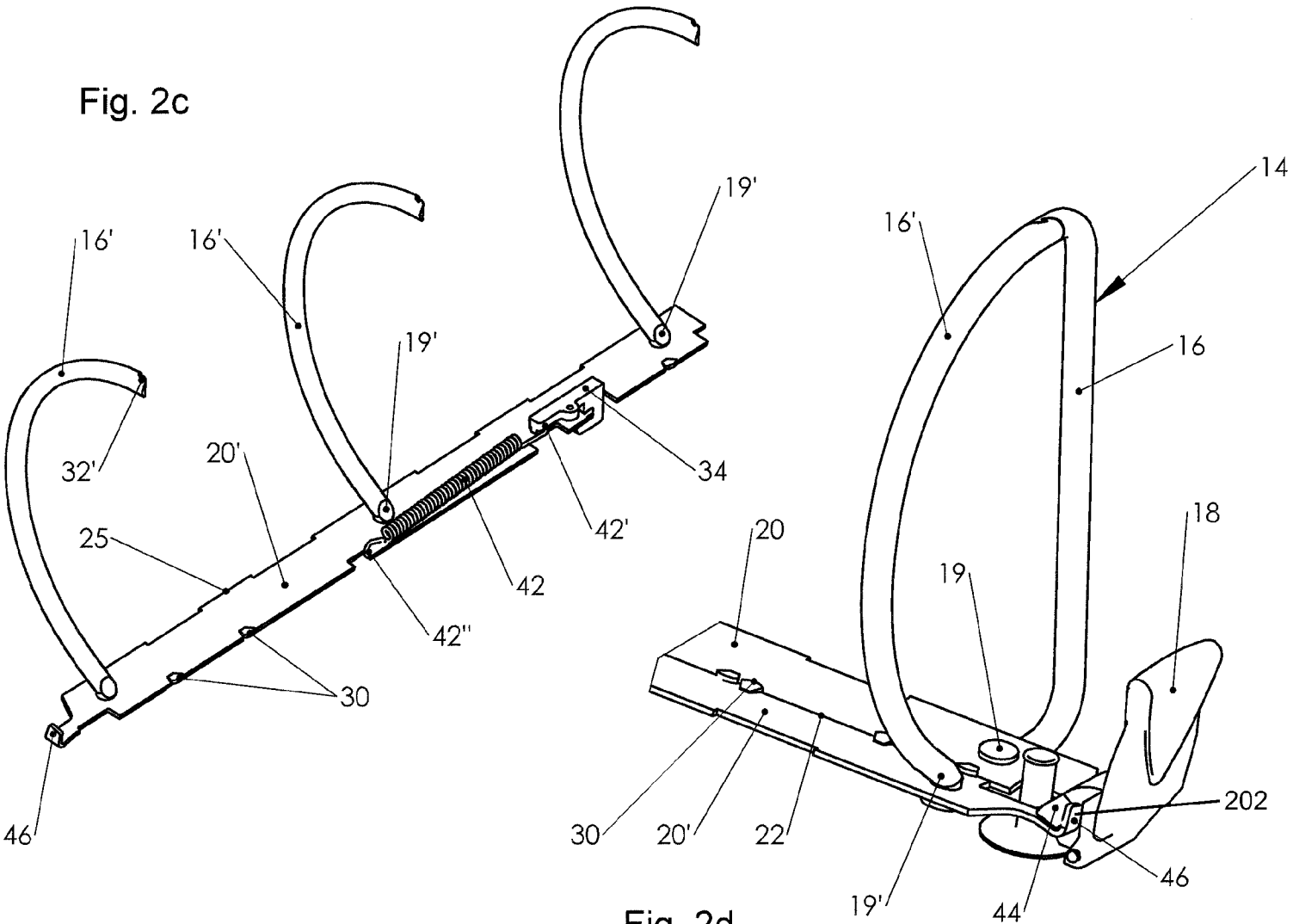
FIGS. 2*c*-2*g* depict different portions and/or elements of the example binder apparatus of FIGS. 1*a*-1*c*.
Figure 2H:
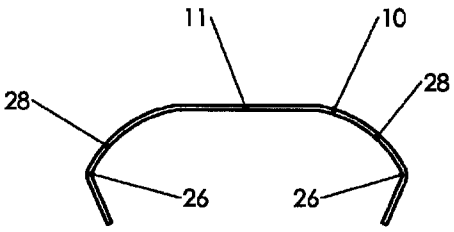
FIG. 2*h* depicts a cross-sectional view of an example housing of the example binder apparatus of FIGS. 1*a*-1*c*.
Figure 2G:
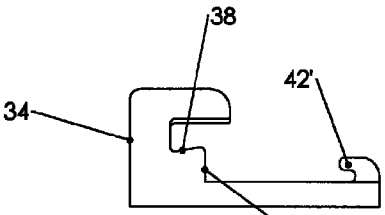
Figure 2F:
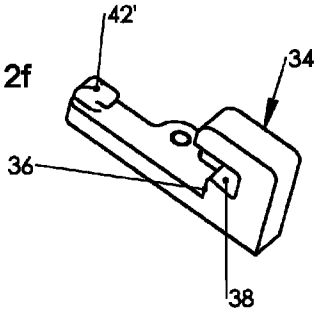
Figure 2E:
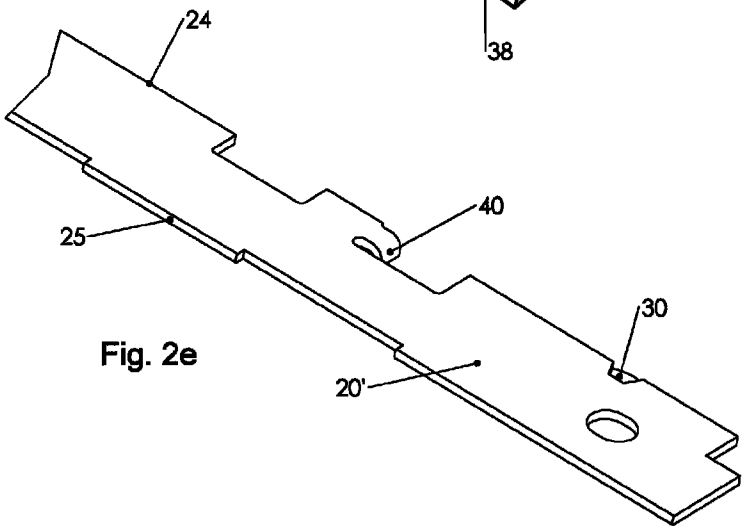

The example binder apparatus described herein may be used to hold materials such as loose perforated sheets, documents, printed matter, plastic sheets, etc. Referring to FIGS. 1-1*c*, an example binder apparatus 100 is depicted that includes a housing 10 having a C-shaped cross-section. The housing 10 includes a central housing wall or portion 11 (FIG. 2*h*) and two lateral housing flanks or portions 28. The flanks 28 are bent from the central portion 11 to form bearing channels or grooves 26 (more clearly shown in FIG. 2*h*). The binder apparatus 100 may include three closure members, half ring, hook or attachment pairs 16 and 16'. The half ring pairs 16 and 16' are longitudinally spaced from one another. The half rings 16 and 16' may penetrate and/or extend through holes, openings or apertures 12 and 12' defined by the housing 10. The half rings 16 and 16' may form a ring 14 or any other shape (e.g., a D-shape, etc.) when the binder apparatus 100 is in the closed position. The binder apparatus 100 may include an actuating member or lever 18 to open and/or close the half rings 16 and 16'.

The half rings 16 and 16 include roots or ends 19 and 19' (FIG. 2*d*) that may be respectively coupled to first and second support rails or portions 20 and 20'. In some examples, the first support rail 20 may not be longitudinally displaceable relative to the housing 10 and the second support rail 20' may be longitudinally displaceable relative to the housing 10. However, in other examples, the support rails 20 and 20' may be longitudinally moveably relative to one another. The support rails 20 and 20' may directly and/or indirectly abut one another at their inner longitudinal edges 24 (FIG. 2*a*) to form a pivot axis 22. If the support rails 20 and 20' indirectly abut one another, hinge elements and/or joints 23' and/23" (FIGS. 8 and 9) may be positioned between the support rails 20 and 20'. Outer longitudinal edges 25 of the support rails 20 and 20' may be positioned within and/or engage the opposing channels 26. The channels 26 may be impressed and/or formed in the flanks 28.

Figure 8A:
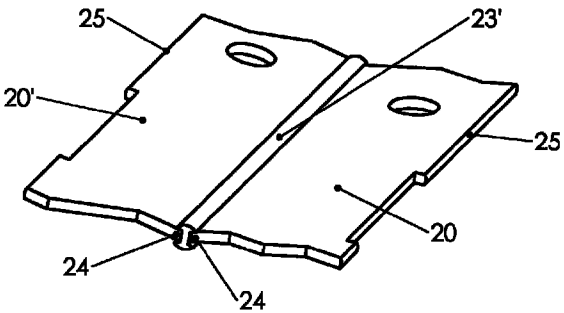
FIG. 8*a* depicts an example elongated hinge element positioned between example support rails.
Figure 9B:
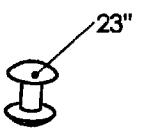
FIG. 9*b* depicts a perspective view of the example hinge element of FIG. 9*a*.
Figure 8B:
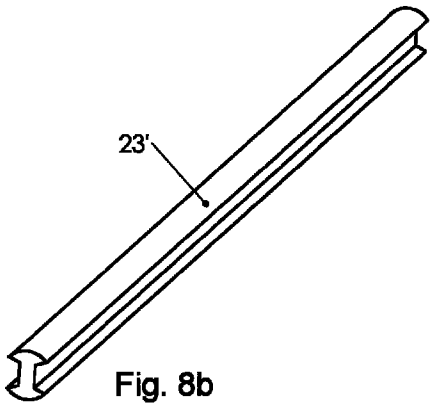
FIG. 8*b* depicts a perspective view of the example elongated hinge element of FIG. 8*a*.
Figure 9A:
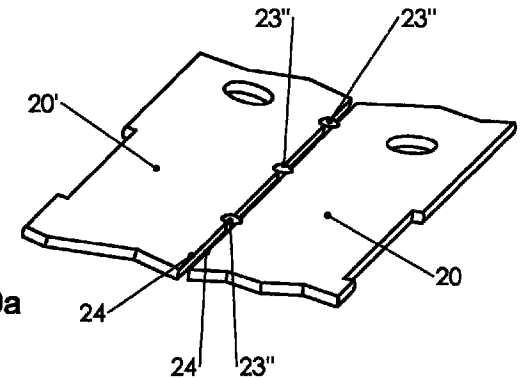
FIG. 9*a* depicts another example hinge element positioned between example support rails.

FIGS. 8*a* and 8*b* depict the hinge element 23' having an elongated double-T shaped profile and/or an elongated profile. The hinge element 23' defines a groove(s) to receive the inner longitudinal edges 24 of the respective support rails 20 and 20'. The hinge element 23' may be made of an elastomer or rubber material. However, any other suitable material may be used instead. FIGS. 9*a* and 9*b* depict the hinge element 23" as a plurality of elements, double-T shaped profiles and/or bodies. The hinge element 23" define a groove(s) to receive the inner longitudinal edges 24 of the respective support rails 20 and 20'. The hinge element 23" may be made of a metal material. However, any other suitable material may be used instead.

Figures 4A, 4B, 5A, 5B, 6A, 6B:
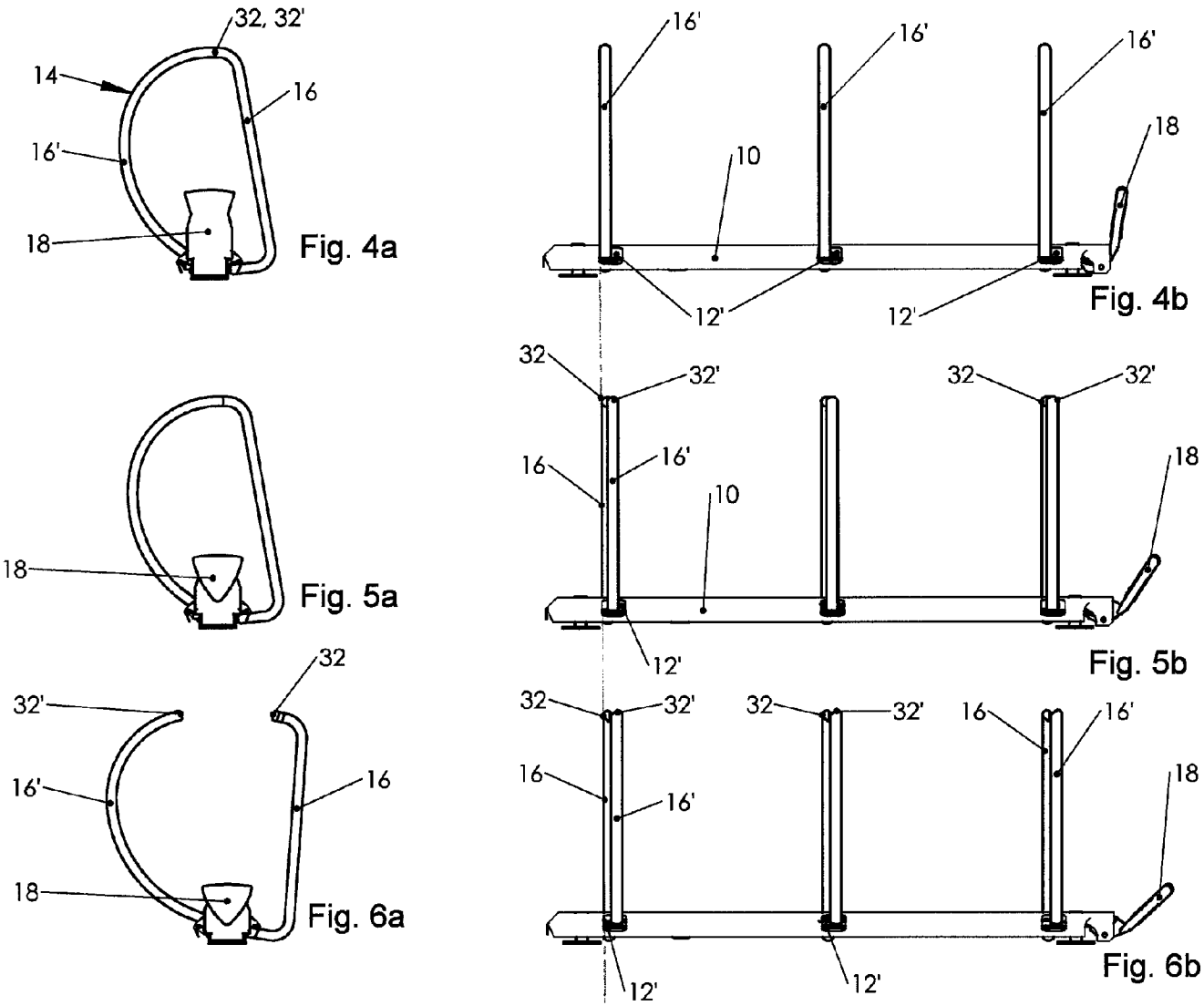
FIGS. 4*a*-4*g* depict different portions and/or components of the example binder apparatus of FIGS. 1*a*-1*c* with the example half rings and example support rails in the closed position.
FIGS. 5*a*-5*g* depict different portions and/or components of the example binder apparatus of FIGS. 4*a*-4*g* with the example half rings and the example support rails in an unlocked closed position.
FIGS. 6*a*-6*f* depict different portions and/or components of the example binder apparatus of FIGS. 4*a*-4*g* with the example half rings and the example support rails in an unlocked open position.

The support rails 20 and 20' may be positioned within the housing 10 to enable the support rails 20 and 20' to be secured in at least a first and second stable position. The first stable position may be associated with the half rings 16 and 16' being in the closed position to form the ring 14 (see FIG. 4*a*). The second stable position may be associated with the half rings 16 and 16' being in the open position (See FIG. 6*a*). By interacting with the support rails 20 and 20', the housing 10 may act as a retaining element and/or spring element that secures and/or fixes the half rings 16 and 16' in the open and/or closed positions.

A plurality of entrainers and/or tabs 30 may be positioned adjacent the inner longitudinal edges 24 of the support rails 20 and 20' to substantially ensure that the support rails 20 and 20' abut one another obtusely. Additionally or alternatively, the hinge elements 23' and/or 23" may be positioned between the inner longitudinal edges 24 of the support rails 20 and 20' to substantially ensure that the support rails 20 and 20' abut one another obtusely. The support rails 20 and 20' may act as a toggle lever between the open and closed positions. The support rails 20 and 20' may be hinged with the outer longitudinal edges 25 positioned within the channels 26. As such, the support rails 20 and 20' may be pivoted in a restricted manner against one another about the pivot axis 22 while moving the half rings 16 and 16' between the open and closed positions.

In some examples, the half rings 16 and 16' may include a locking mechanism to further secure the half rings 16 and 16' in the closed position. The locking mechanism may include hook-like locking elements 32 and 32' positioned at the free ends of one or more of the half rings 16 and 16'. The locking elements 32 and 32' may complement and/or interact with one another to secure the half rings 16 and 16' in the closed position and substantially prevent the half rings 16 and 16' and/or the support rails 20 and 20' from pivoting about the pivot axis 22 when the binder apparatus 100 is in the closed position. The locking elements 32 and 32' may be formed from and/or integral with the respective half rings 16 and 16'.

To enable the enable the half rings 16 and 16' to be opened from the closed and/or locked position, the locking elements 32 and 32' may be unlocked to enable the support rails 20 and/or 20' to be pivoted about the pivot axis 22.

To open and/or close the binder apparatus 100, the second support rails 20' may be translated, displaced and/or moved relative to the housing 10 substantially parallel to the pivot axis 22 and the first support rail 20 may be fixed and/or secured relative to the housing 10 (e.g., substantially no longitudinal movement). To enable the second support rail 20' to move and/or translate within the housing 10, the holes 12' through which the half rings 16' extend may be elongated and/or oblong shaped.

Figures 4C, 4D, 4E, 5C, 5D, 5E, 6C, 6D, 6E:
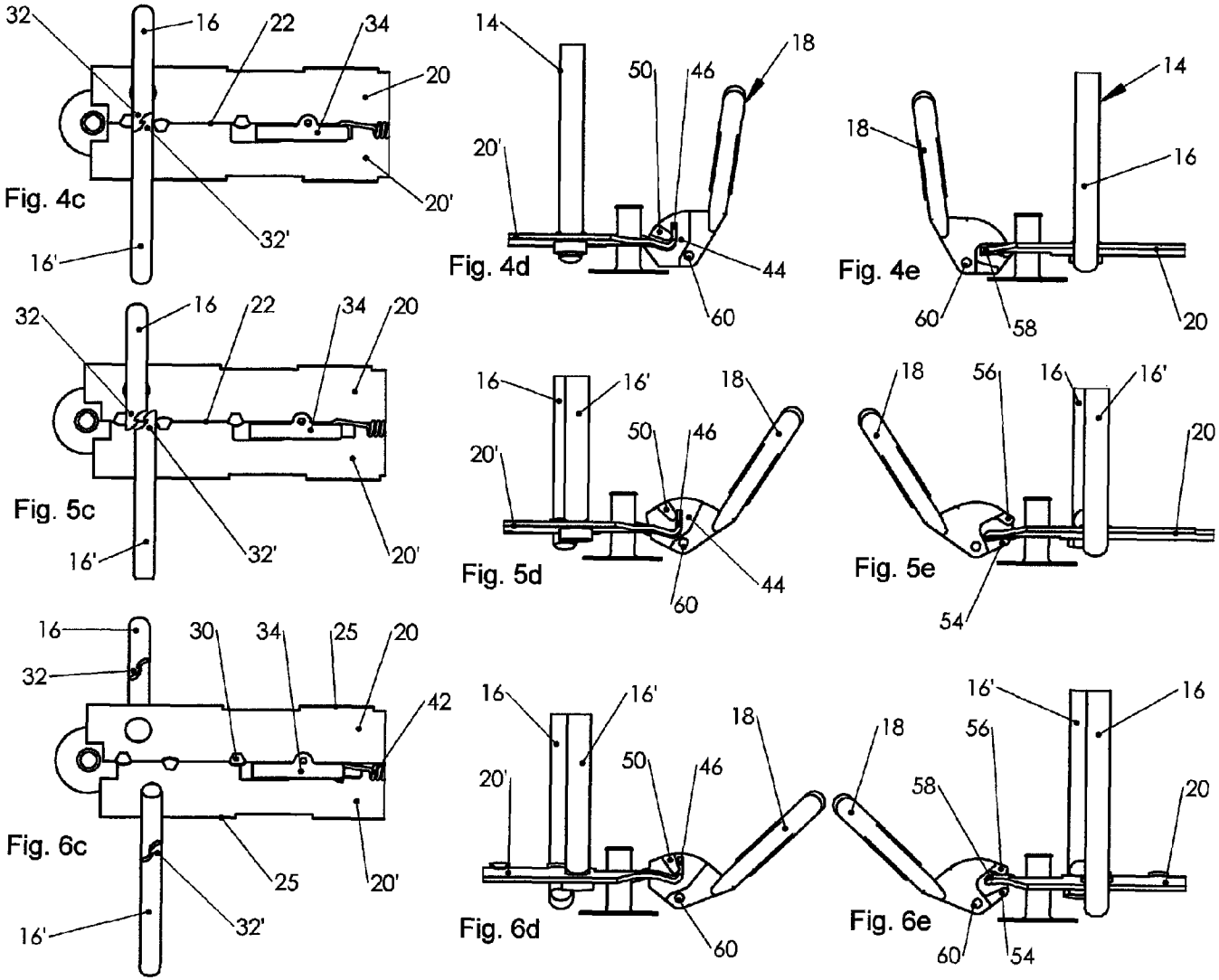

The holes 12' enable the second support rail 20' to be moveable and/or displaceable relative to the first support rail 20 at the beginning of the opening operation to enable the locking elements 32 and 32' to move from the locked position (see FIG. 4*c*) to the unlocked position (see FIG. 5*c*) and for the half rings 16 and 16' to be subsequently moved to the open position (see FIG. 6*c*). The holes 12' also enable the second support rail 20' to be moveable and/or displaceable relative to the first support rail 20 at the beginning of the closing operation to enable the half rings 16 and 16' to move from the open position (see FIG. 6*c*) to the closed position with the locking elements 32 and 32' being moved from the unlocked position (see FIG. 5*c*) to the locked position (See FIG. 4*c*).

To enable the locking elements 32 and 32 to be moved from the unlocked position to the locked position, the second support rail 20' may be shifted and/or moved relative to the first support rail 20 between a position in which the locking element 32 and 32' are open, unlocked and/or exposed and to a position in which the locking element 32 and 32' are closed, locked and/or overlapping. In some examples, the second support rail 20' may be positioned such that the locking elements 32 and 32' overlap before the half rings 16 and 16' are positioned in the closed position. In such examples, when the half rings 16 and 16' reach the closed position, the elasticity of the half rings 16 and 16' enables the locking elements 32 and 32' to shift and engage to secure the locking elements 32 and 32' together.

To control the pivoting movement and/or displacement of the second support rail 20' relative and/or parallel to the pivot axis 22 and/or to control the pivoting movement of the support rails 20' and 20 about the pivot axis 22 and/or relative to one another, the example binder apparatus 100 may include a controller 34. The controller 34 may be coupled to the housing 10 and/or to the first support rail 20. Referring to FIGS. 2*f*, 2*g*, 4*f*, 5*f* and 6*f*, the controller 34 may include a guiding slide or control surface(s) 402 having a first surface or guide path 36 and a second surface or guide path 38 that interact with a glide member or tab 40. The tab 40 may be positioned adjacent or proximate the pivot axis 22 and coupled to the second support rail 20'. The controller 34 includes a groove 404 at least partially defined by the second surface 38 that receives the tab 40. Additionally, the controller 34 includes a first portion 406 positioned on a first side 408 of the second support rail 20', a second portion 410 that extends through an aperture and/or cutout 412 defined by the support rail 20' and/or 20 and a second portion 414 positioned on a second side 416 of the second support rail 20'.

When moving the half rings 16 and 16' from the closed position to the open position, the controller 34 may be configured to, in a first phase, release and/or enable movement of the second support rail 20' substantially parallel to the pivot axis 22 via an interaction between the tab 40 and the second surface 38. The controller 34 may also be configured to, in the first phase, to substantially block, prevent and/or restrict the pivoting movement of the second support rail 20' relative to the pivot axis 22 until the locking elements 32 and 32' are at a distance from one another, out of engagement with one another and/or the unlocked. The controller 34 may be configured to, in a second phase, enable the pivoting movement of the second support rail 20' relative to the pivot axis 22 and/or relative to the first support rail 20 to enable the half rings 16 and 16' to be moved to the opened position. The controller 34 may also be configured to, in the second phase, substantially block, prevent and/or restrict the movement (e.g., parallel movement) of the second support rail 20' via an interaction between the tab 40 and the first surface 36 such that the locking elements 32 and 32' are not moved to the locked position. In the second phase, the first surface 36 may be positioned at a right angle relative to the pivot axis 22 and/or the tab 40.

When moving the half rings 16 and 16' from the open position to the closed position, the controller 34 may be configured to, in a third phase, enable the pivoting movement of the second support rails 20' relative to the pivot axis 22 and/or relative to the first support rail 20 to enable the half rings 16 and 16' to be moved to the closed position. The controller 34 may also be configured to, in the third phase, substantially block, prevent and/or restrict the movement (e.g., parallel movement) of the second support rail 20' via an interaction between the tab 40 and the first surface 36 such that the locking elements 32 and 32' are not moved to the locked position until the half rings 16 and 16' are in the closed position. When moving the half rings 16 and 16' from the open position to the closed position, the controller 34 may be configured to, in a fourth phase, release and/or enable movement of the second support rail 20' substantially parallel to the pivot axis 22 via an interaction between the tab 40 and the second surface 38 to enable the locking elements 32 and 32' to move to the locked, overlapping, secured and/or engaged position. The controller 34 may also be configured to, in the fourth phase, substantially block, prevent and/or restrict the pivoting movement of the second support rail 20' relative to the pivot axis 22. As such, the locking and/or securing of the half rings 16 and 16' and/or the support rails 20' and 20 may occur automatically when closing the binder apparatus 100.

The second support rail 20' may be pre-stressed and/or tensioned during the opening and/or closing process via a spring or biasing element 42 toward an overlapping position in which the locking elements 32 and 32' are in the locked position. The spring 42 may be coupled to the controller 34 and the second support rail 20' at respective suspension points or portions 42' and 42" (see FIGS. 2*b*, 2*c*, 4*f* and 5*f*). Alternatively, if the controller 34 is coupled to the housing 10, the spring 42 may be coupled to the second support rail 20', the housing 10 and/or the controller 34, for example.

Figure 4G:
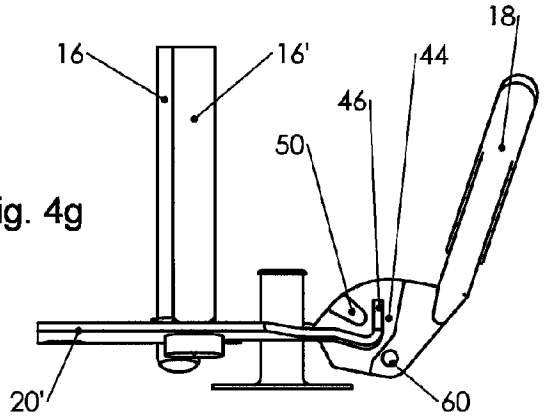
Figure 7A:
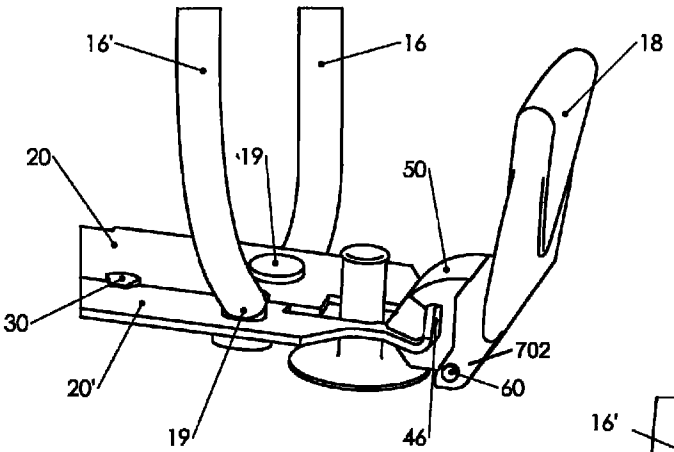
FIG. 7*a* depicts an actuating example element positioned between an example lever and an example displaceable support rail.
Figure 7B:
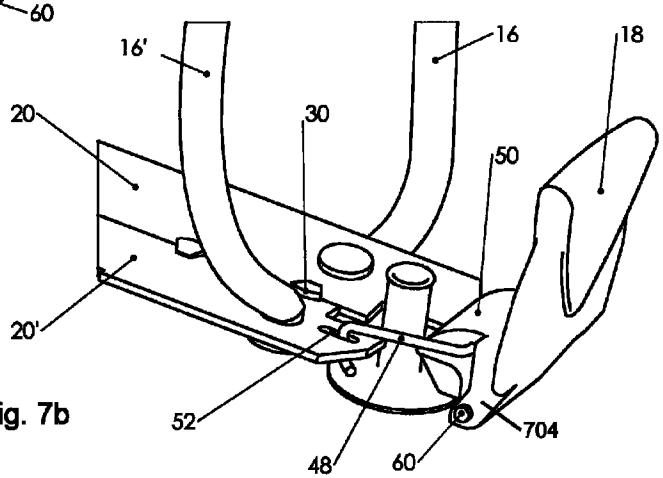
FIG. 7*b* depicts another example actuating element positioned between an example lever and an example displaceable support rail.

The spring 42 may be pre-stressed and/or tensioned by the lever 18 predominantly when the binder apparatus 100 is being opened. The lever 18 may include a coupling point, portion area, and/or surface 44 that may engage and/or receive the second support rail 20'. As illustrated in FIGS. 4*g* and 7*a*, the coupling area 44 is a groove or slot defined on the lever 18 through which an end 46 of the second support rail 20' extends with at least some clearance. The end 46 may have a bent portion 202 that wraps about and/or is positioned adjacent to the coupling area 44 (see FIG. 7*a*). As illustrated in FIG. 7*b*, the coupling area 44 may include an actuating member, a push/pull member or wire 48 that extends between a lever arm 50 of the lever 18 and the second support rail 20'. The wire 48 may extend through an oblong hole or aperture 52 defined by the second support rail 20' to couple the wire 48 and, in turn, the lever 18 to the second support rail 20'. A first side 702, 704 (FIGS. 7*a* and 7*b*) of the lever 18 may be used to displace and/or move the second support rail 20'.

Figure 3B:
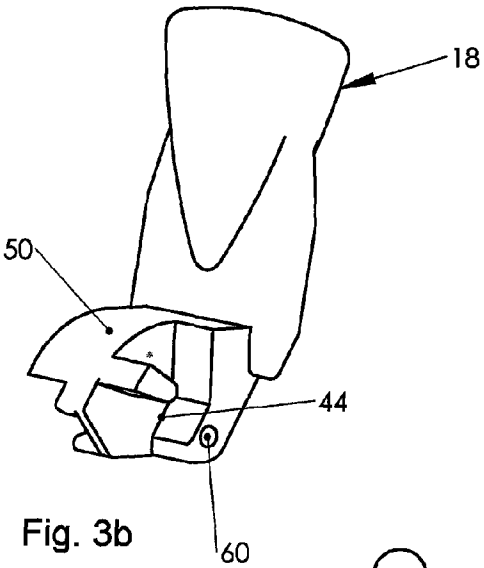
FIGS. 3*a*-3*d* depict different views of an example actuating member that may be used in connection with the example binder apparatus of FIGS. 1*a*-1*c*.
Figure 3D:
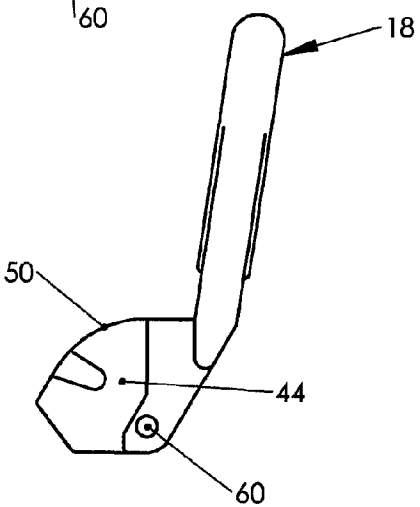
Figure 3A:
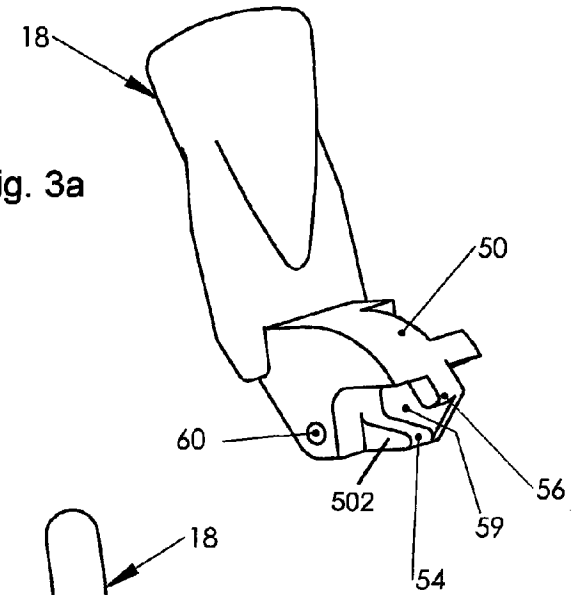
Figure 3C:
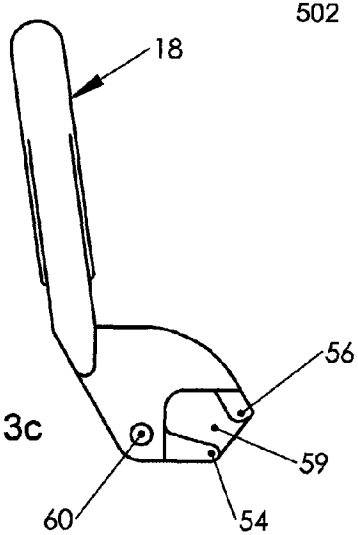
Figure 5G:
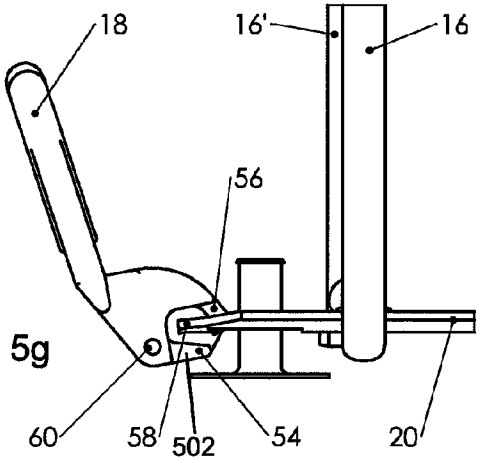
Figure 4F:
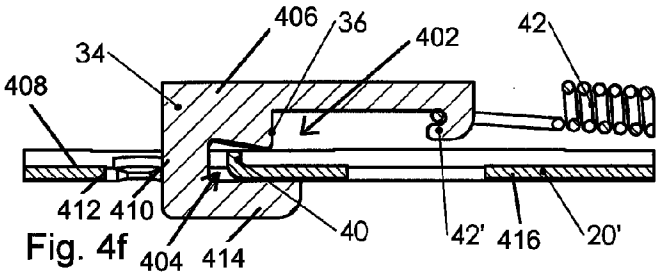
Figure 5F:
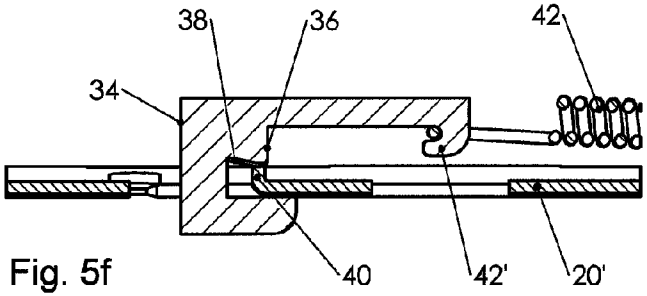
Figure 6F:
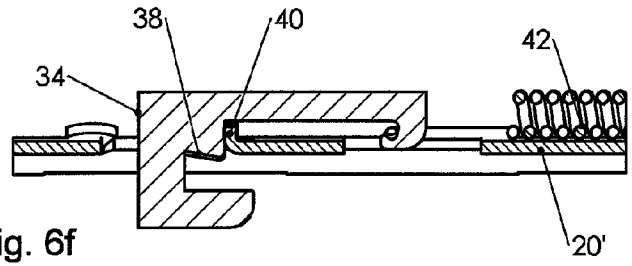

A gap or groove 59 (see FIGS. 3*a*, 3*c*) may be at least partially defined by an opening arm or surface 54 and a closing arm or surface 56 positioned on a second side 502 (FIG. 5*g*) of the lever 18. The groove 59 may receive and/or hold a free end 58 of the first support rail 20 (See FIGS. 4*e*, 5*e* and 6*e*). The pivoting movement of the support rails 20 and 20' may be triggered and/or initiated by the first support rail 20. The first support rail 20 may be coupled to the second support rail 20' via the tabs 30 and/or the hinge element 23' and/or 23". The sides 702 and/or 704 and 502 of the lever 18 may be sized and/or include clearances to enable the binder apparatus 100 to be opened and/or closed as shown in, for example, FIGS. 4*f*, 5*f* and 6*f*. The lever 18 may be pivotable about an axis 60 positioned at a substantially right angle relative to the pivot axis 22 and substantially parallel to the central portion 11.

The lever 18 may include two active actuating positions to move and/or actuate the support rails 20 and/or 20'. One of the active actuating positions may be in the opening direction and the other of the active actuating positions may be in the closing direction. To unlock and/or lock the locking elements 32 and 32', the second support rail 20' is moveable and/or displaceable relative to and/or in the direction of the pivot axis 22 and the first support rail 20. To open and/or close the half rings 16 and 16', the support rail 20 and/or 20' is pivoted around the pivot axis 22.

FIGS. 10*a*-14*b* depict an example binder apparatus 1000 that is different than the binder apparatus 100 described above. For example, in contrast to the binder apparatus 100, the central half ring pair 16 and 16' includes the locking elements 32 and 32' while other half ring pairs 16" and 16'" do not include the locking elements 32 and 32'. Additionally, in contrast to the binder apparatus 100 described above, the central half ring 16' is coupled at the end 19 to an example support rail section or portion or swivel portion 62 of the second support rail 20'. The swivel portion 62 may be rotatable relative to and/or opposite to the first support rail 20.

The second support rail 20' includes a non-displaceable or non-translatable support rail portion or body 64 (e.g., substantially not longitudinally movable). As illustrated in FIGS. 11*b*, 12*b*, 13*a* and 14*a*, the half ring pairs 16" and 16'" are coupled to the support rail portion 64. The half ring pairs 16" and 16'" include a wedge lock or coupling element 66 that acts and/or secures the half ring pairs 16" and 16'" in the longitudinal direction when the support rails 20 and 20' are in the closed position.

Figures 10A, 10B:
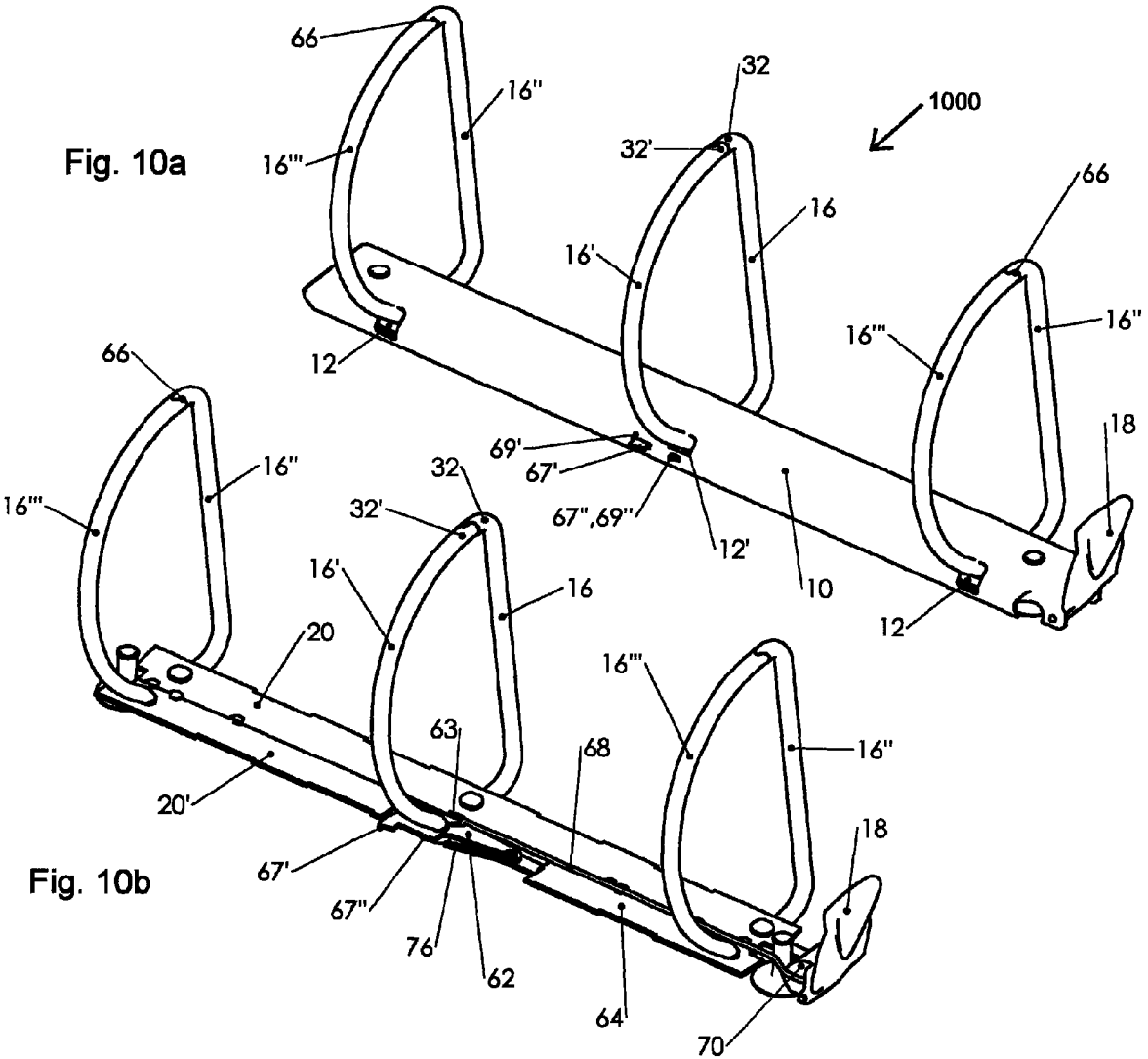
FIG. 10*a* depicts another example binder apparatus having an example swivel portion.
FIG. 10*b* depicts the example binder apparatus of FIG. 10*a* with the example binder housing removed.
Figures 10C, 10D, 10F, 10G, 10H:
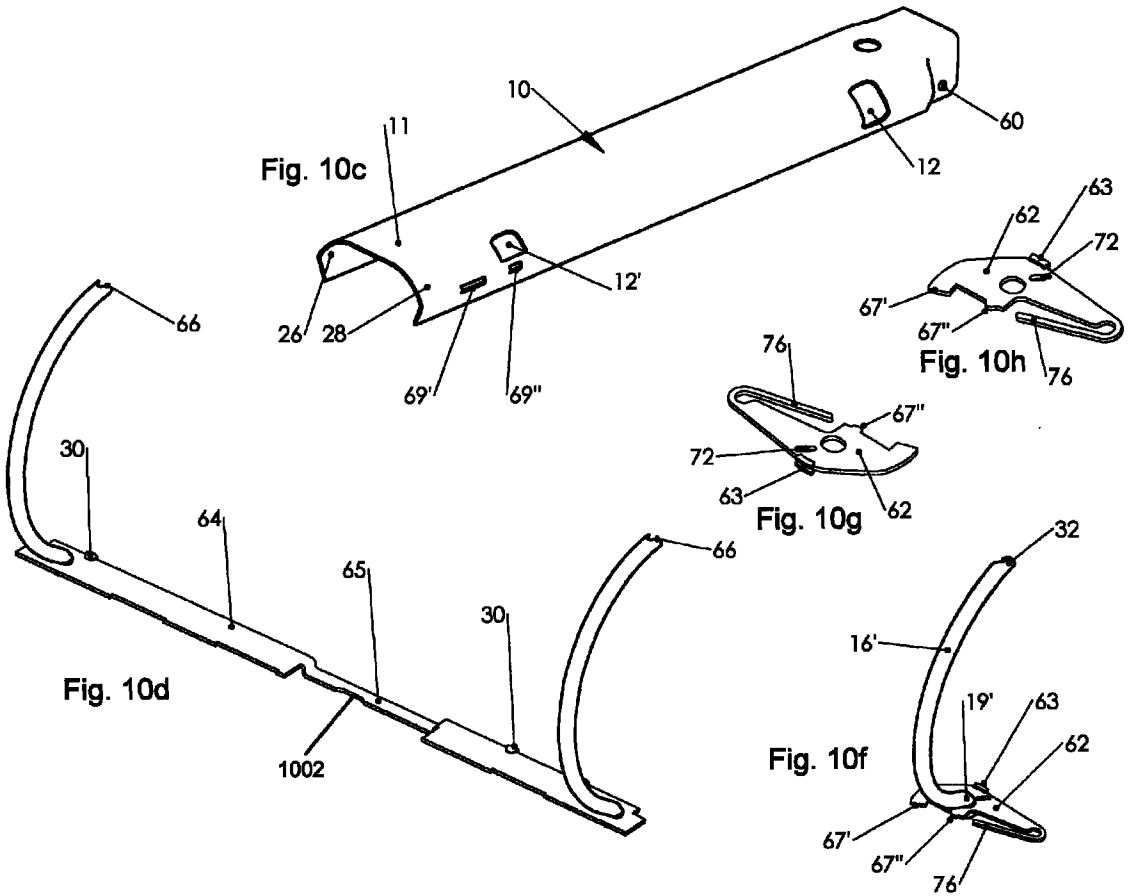
FIGS. 10*c*-10*d*, 10*f*-10*k* depict different portions and/or components of the example binder apparatus of FIGS. 10*a* and 10*b*.
Figure 10I:
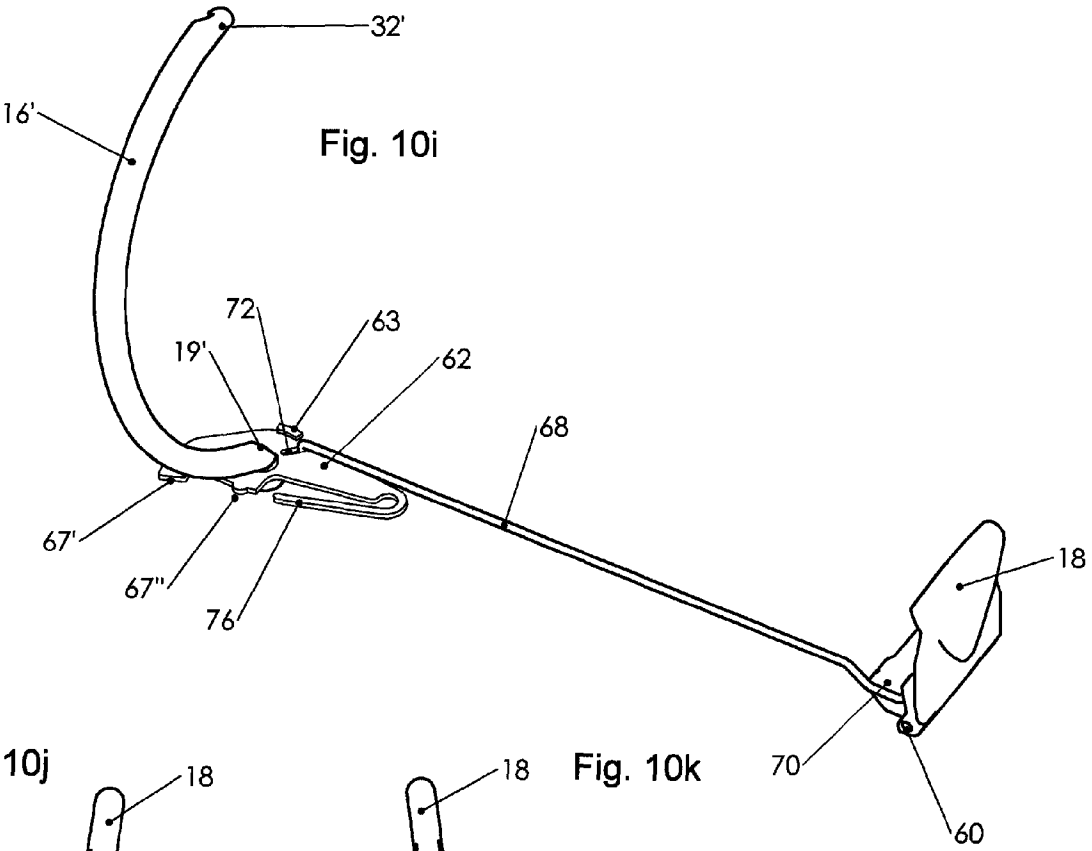
Figure 10K:
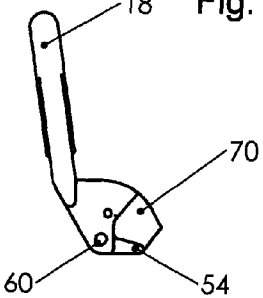
Figure 10J:
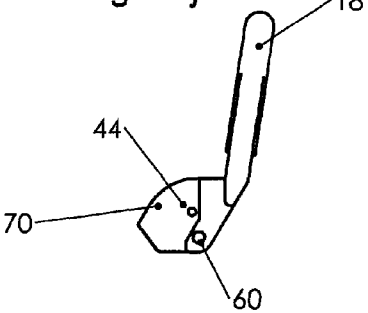
Figure 12A:
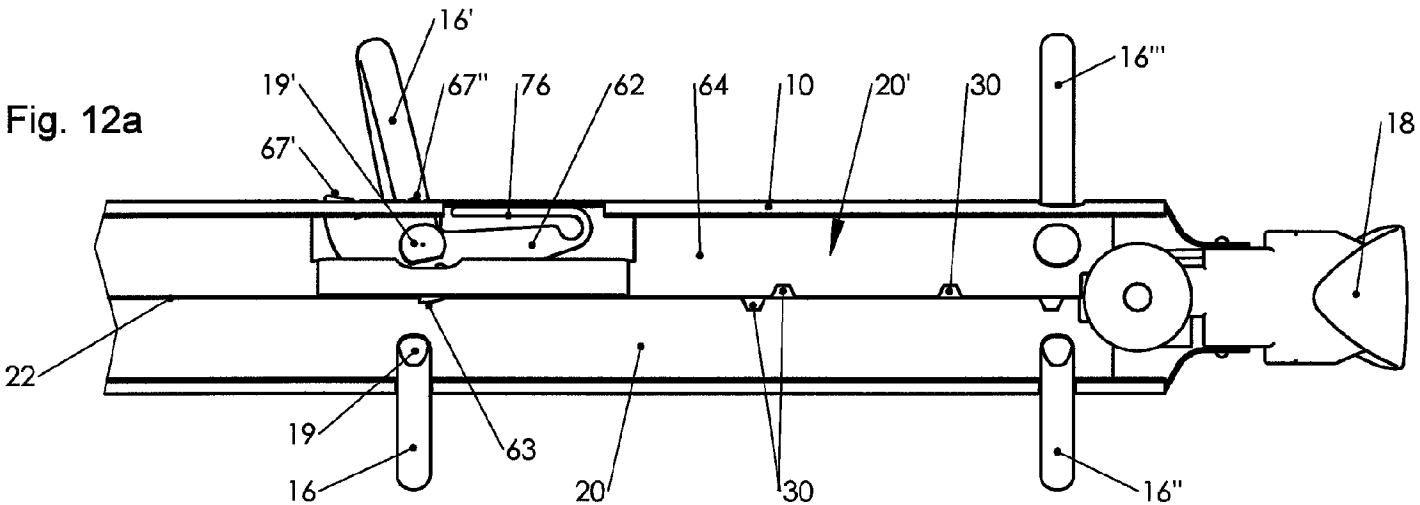
FIGS. 12*a*-12*c* depict a bottom view, a top view and a cutout lateral view of the example binder apparatus of FIGS. 10*a* and 10*b* with the example half rings and the example support rails in an unlocked closed position.

As illustrated in FIG. 10*d*, the support rail portion 64 may include a central portion or web 65 upon which the swivel portion 62 may be positioned and/or supported in a movable and/or slidable manner. The swivel portion 62 may include a guide shoe or grooved portion 63 that interacts with and/or receives an inner edge 1002 to support and/or position the swivel portion 62 relative to the support rail portion 64. The interaction between the grooved portion 63 and the inner edge 1002 may enable the swivel portion 62 to be longitudinally guided relative to and/or along the inner edge 1002. The interaction between the grooved portion 63 and the inner edge 1002 may enable the swivel portion 62 to swiveled and/or pivoted relative to the pivot axis 22.

The tabs 30 on the support rail portion 64 may substantially ensure that the support rails 20 and 20' abut one another obtusely at their inner longitudinal edges 24. Supporting noses, extensions and/or portion 67' and 67" may be positioned on an exterior edge of the swivel portion 62. When the binder apparatus 1000 is in the closed position, the supporting extensions 67' and 67" may extend through recesses and/or apertures 69' and 69" (See FIG. 10*a*) of the housing 10 to substantially secure the swivel portion 62 relative to the housing 10.

A biasing element or spring element 76 may be molded on the swivel portion 62. When the binder apparatus 1000 is in the closed position, the spring element 76 may engage and/or interact with the flank 28 to pre-stress and/or tension the swivel portion 62 toward the overlapping and/or locking position such that the locking element 32' engages and/or locks with the locking element 32 (See FIGS. 11*a*, 11*b*, 12*a* and 12*b*).

Figure 12C:
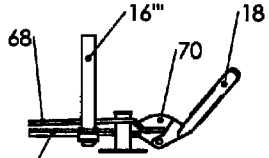
Figure 12B:
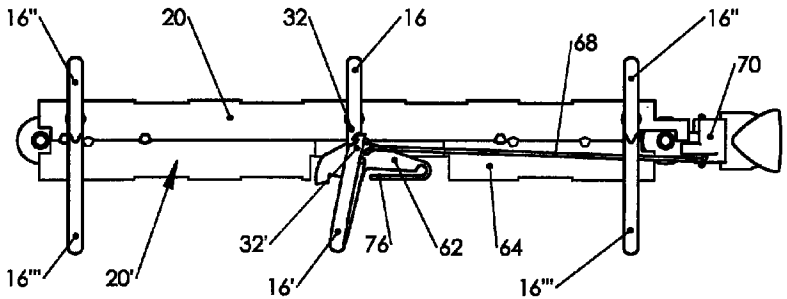
Figure 13A:
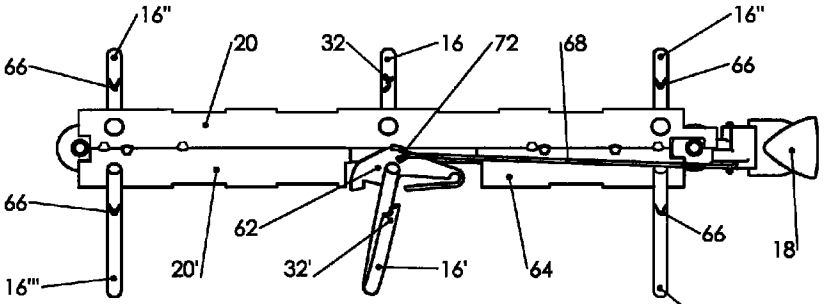
FIGS. 13*a* and 13*b* depict different views of the example binder apparatus of FIGS. 12*b* and 12*c* with the example half rings and the example support rails in an unlocked open position.
Figure 13B:
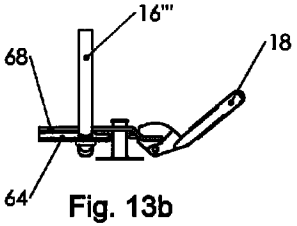

The half ring 16' of the binder apparatus 1000 may be limitedly pivoted relative to the half ring 16 by rotating the swivel portion 62, thereby moving the locking elements 32 and/or 32' from the overlapping or locked position (FIG. 11*b*) to the exposed or unlocked position (FIG. 12*b*). In the overlapping position, the half ring 16' may be in line with or substantially parallel to the half ring 16. In the exposed position, the half ring 16' may be offset relative to the half ring 16 such that the locking elements 32 and 32' are not engaging and the support rails 20 and 20' and the associated half rings 16 and 16 may be pivoted about the pivot axis 22 to the open position (see FIG. 13*a*).

To actuate the swivel portion 62, the binder apparatus 100 includes a pull rod, actuating element or portion 68 that extends between a lever arm 70 of the lever 18 and a slot or opening 72 in the swivel portion 62. The interaction between the lever 18, the actuating element 68, the swivel portion 62 and/or the support rails 20 and/or 20' enables the locking elements 32 and 32' to be moved between the locking and/or unlocking positions and/or to pivot the support rails 20 and/or 20' relative to the pivot axis 22 to open and close the binder apparatus 1000 and, more generally, to control the sequence of opening and/or closing the binder apparatus 1000. FIGS. 11, 12, 13 and 14 depict a sequence of opening the binder apparatus 1000 where FIGS. 11*a*, 11*b*, 12*a* and 12 depict pivoting of the swivel portion 62 and unlocking of the locking elements 32 and 32' and FIGS. 12*a*, 12*b*, 13*a* and 13*b* depict the opening operation.

Figure 14A:
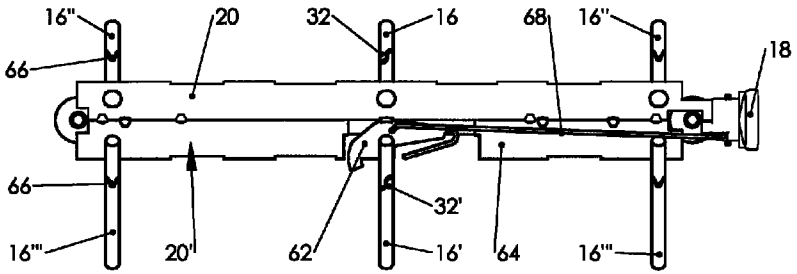
FIGS. 14*a* and 14*b* depict different views of the example binder apparatus of FIGS. 13*a* and 13*b* with the example half ring of the example swivel portion aligned with the corresponding half ring.
Figure 14B:
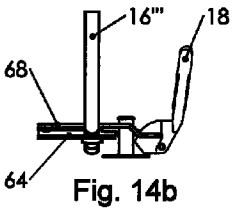

As illustrated in FIGS. 14*a* and 14*b*, because the binder apparatus 1000 may not include the closing arm or surface on the lever 18, the lever 18 and/or the swivel portion 62 may be moved to position the half rings 16 and 16' from the offset position (see FIG. 13*a*) to the inline position (see FIG. 14*a*) without closing the half rings 16 and 16'. With the half rings 16 and 16' aligned, documents, etc. may be easily added to and/or removed from the binder apparatus 1000. In contrast to the half rings 16 and 16', the exterior half rings 16" and 16' may not rotate or turn when the binder apparatus 1000 is opened or closed. The wedge lock 66 at the ends of the half rings 16" and 16'" enables the half rings 16" and 16'" to be moved relative to one another without locking in the same manner as the locking elements 32 and 32'.

Figure 11A:
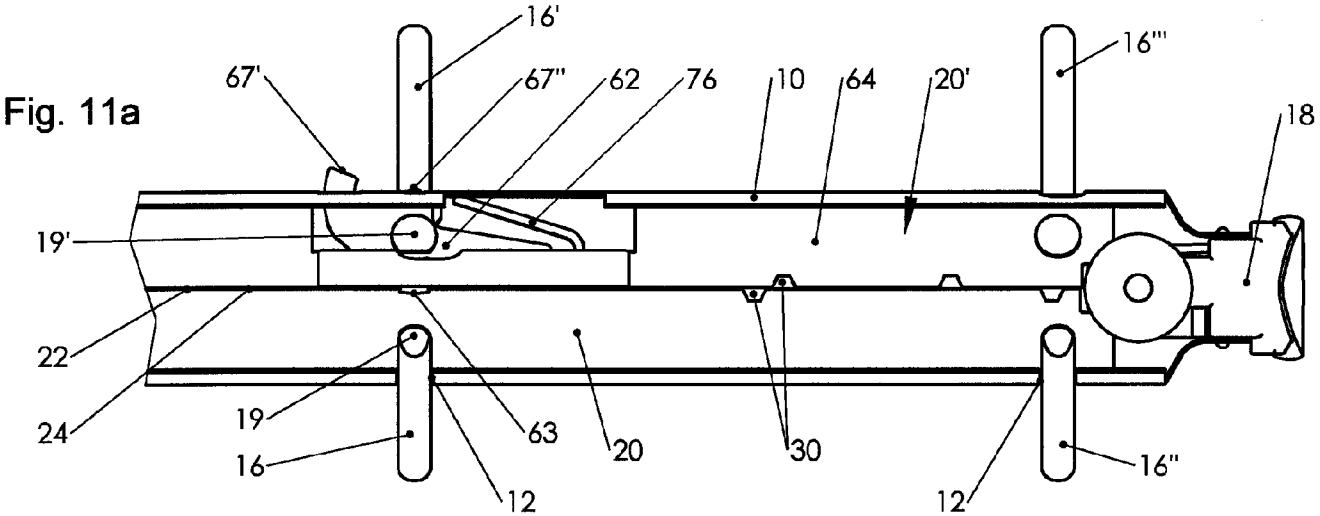
FIGS. 11*a*-11*c* depict a bottom view, a top view and a cutout lateral view of the example binder apparatus of FIGS. 10*a* and 10*b* with the example half rings and the example support rails in a locked closed position.
Figure 11C:
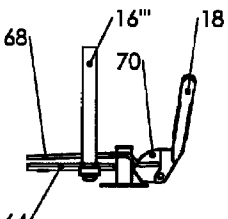
Figure 11B:
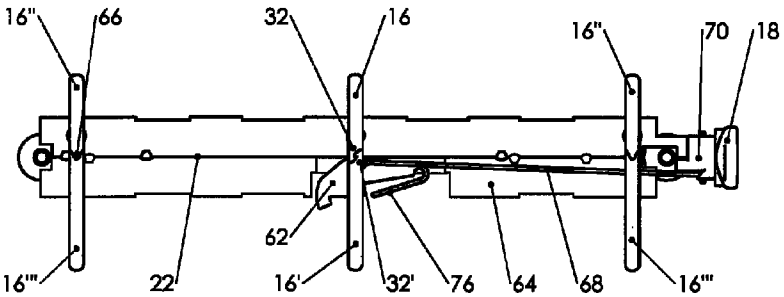

The binder apparatus 1000 may be closed by manually moving one or more of the half rings 16, 16', 16" and/or 16'" toward the closed position instead of using the lever 18. As the support rails 20 and 20' are moved toward the closed position, the swivel portion 62 and/or the half rings 16 and/or 16' move and/or interact to enable the locking elements 32 and 32' to move to the overlapping or locked position as shown in FIG. 11. The lever 18 may include an opening arm or surface (e.g., similar to the opening arm 54) that abuts and/or interacts with the first support rail 20 to open the binder apparatus 1000, for example. The lever 18 of the binder apparatus 1000 may also include a closing arm or surface (e.g., similar to the closing arm 56) to enable the closing of the binder apparatus 1000 using the lever 18.

FIGS. 15*a*-16*b* depicts an example binder apparatus 1500 that is similar to the example binder apparatus 1000 of FIGS. 10-14. However, in contrast, each of the half rings 16 and 16' of the example binder apparatus 1500 include the locking elements 32 and 32' that overlap and/or interlock in the closed position to substantially prevent the binder apparatus 1500 from inadvertently opening. The first support rail 20 of the binder apparatus 1500 may be undisplaceable and/or non-translatable within the housing 10 (e.g., substantially no longitudinal movement). The second support rail 20' of the binder apparatus 1500 includes three support rail sections or swivel portions 62 adjacent the first support rail 20. Half rings 16' are coupled at their ends 19 to the respective swivel portions 62.

Figures 15A, 15B, 15C, 15D:
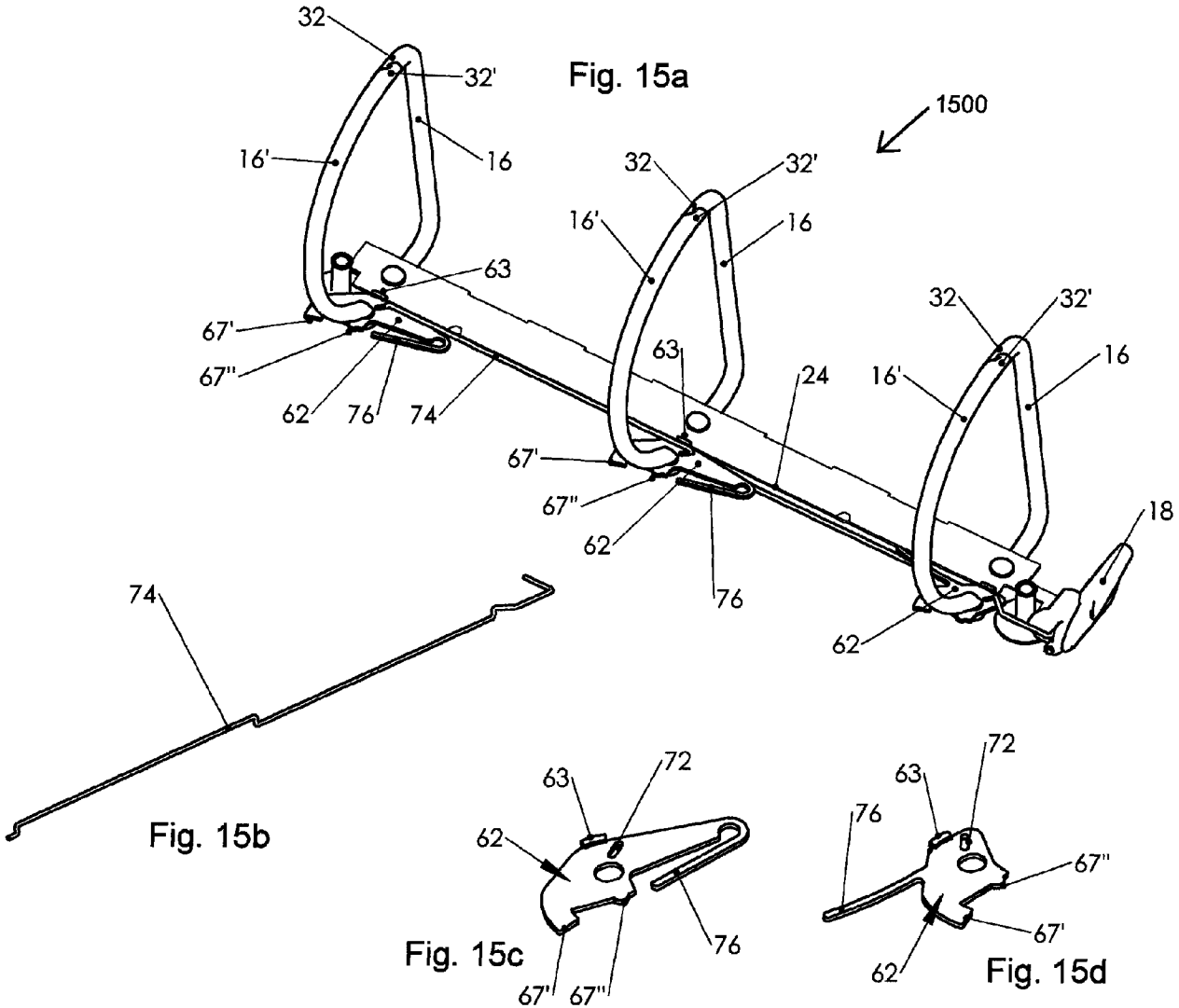
FIG. 15*a* depicts another example binder apparatus with the example binder housing removed having a plurality of example pivoting support rail section with the example half rings and the example support rails in a locked closed position.
FIGS. 15*b*-15*d* depict different portions and/or components of the example binder apparatus of FIG. 15*a*.

The swivel portions 62 may each be supported relative to the first support rail 20 via a guide shoe or grooved portion 63. Also, the swivel portions 62 may include supporting noses or extensions 67' and 67" that are received by apertures or openings (not shown) of the housing flanks (not shown). The swivel portions 62 may include spring elements 76 that interact and/or engage with inner surfaces of the housing and/or the longitudinal edge 24 of the adjacent support rail 20 to pre-stress and/or tension the swivel portions 62 and urge the half rings 16 and/or 16' and, thus, the locking elements 32 and 32' toward the overlapping and/or locking position. As illustrated in FIG. 15*d*, the swivel portion 62 to be positioned adjacent the lever 18 may be slightly different than the swivel portion 62 depicted in FIG. 15*c* that is to be positioned adjacent central half rings 16 and 16', for example.

Figure 16A:
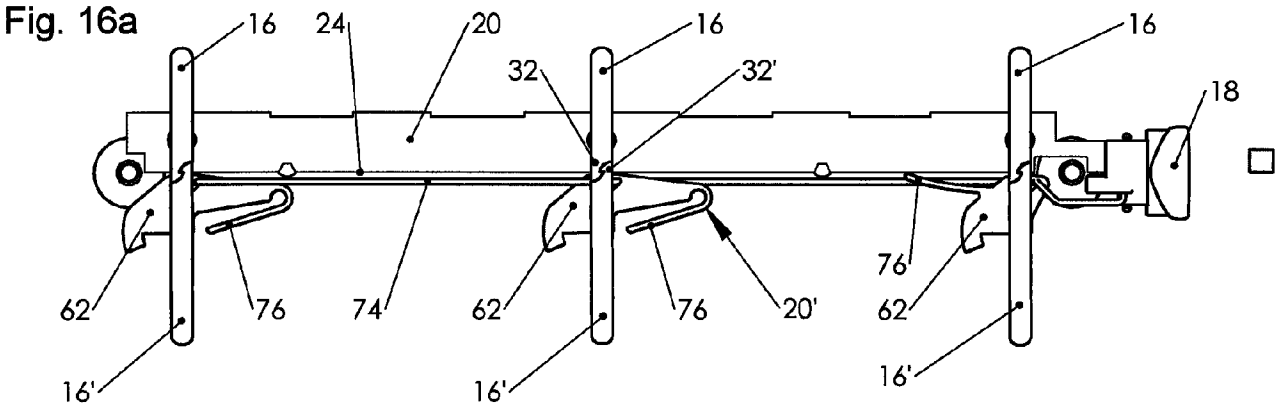
FIG. 16*a* depicts a top view of the example binder apparatus of FIG. 15*a* with the binder housing removed and the example half rings and the example support rails in a locked closed position.
Figure 16B:
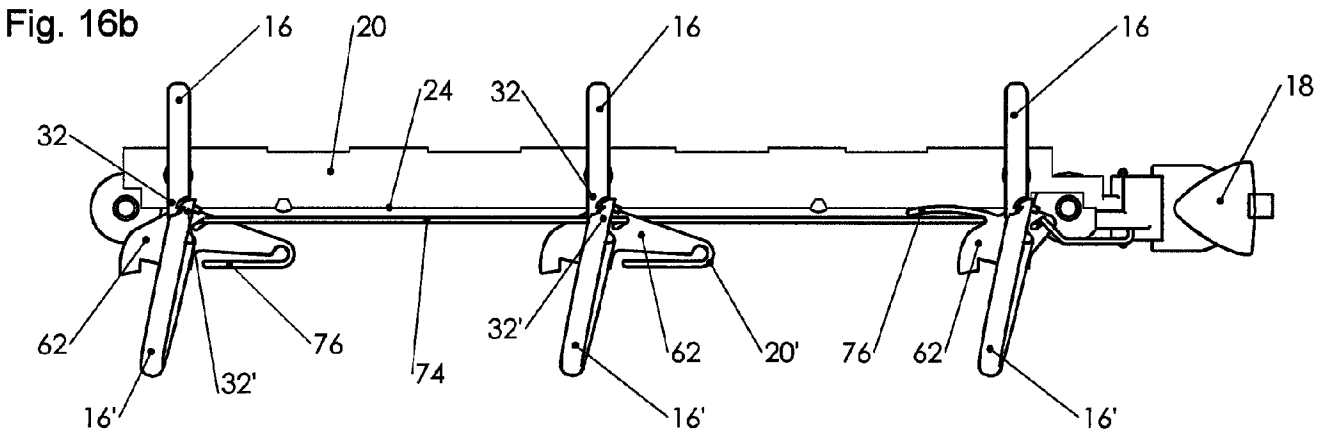
FIG. 16*b* depicts a top of the example binder apparatus of FIG. 15*a* with the binder housing removed and the example half rings and the example support rails in an unlocked closed position.
Figures 17A, 17B, 18A, 18B, 19A, 19B:
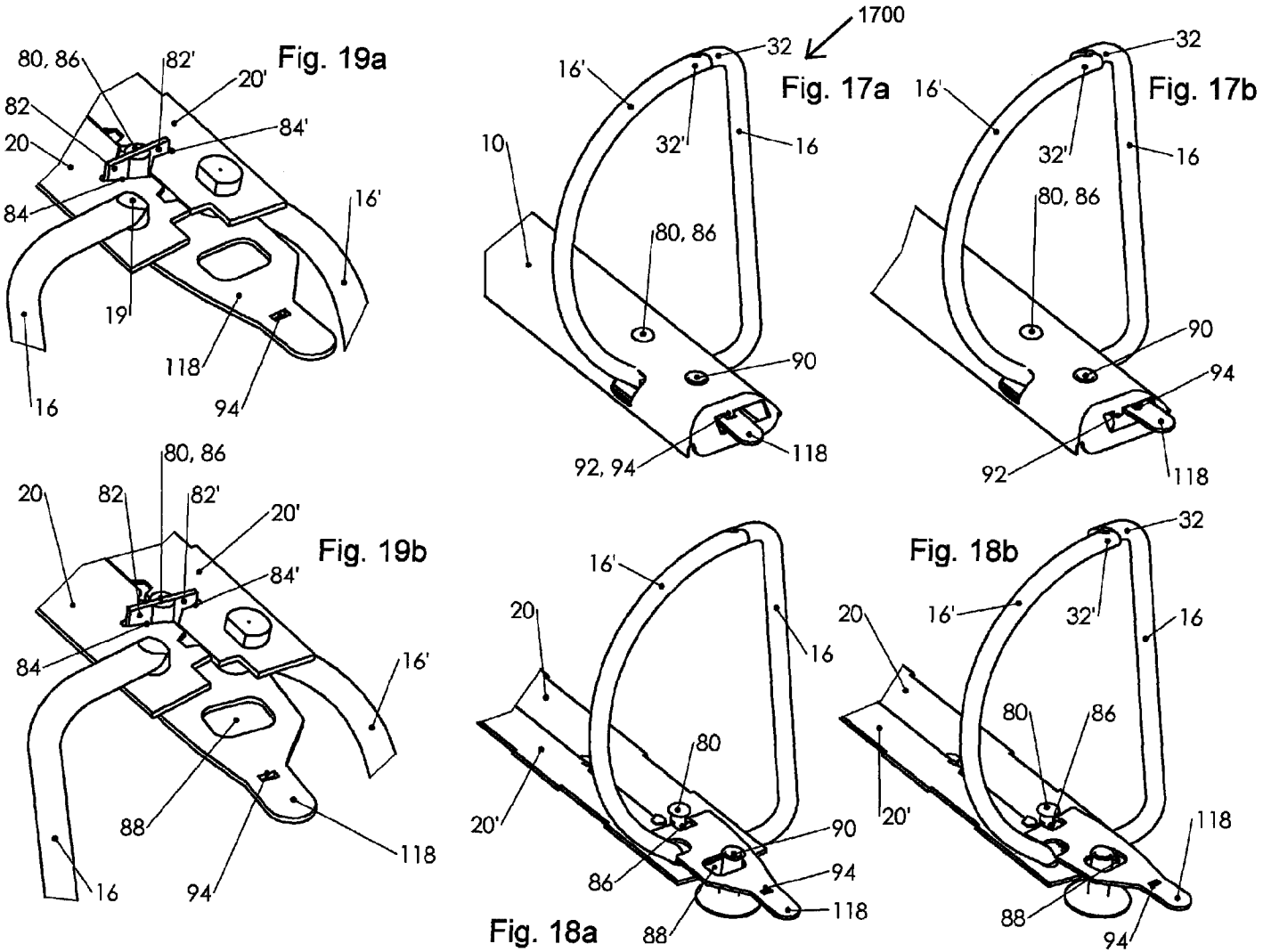
FIGS. 17*a*-17*d* depict a portion of another example binder apparatus having an example actuating lever in different positions.
FIGS. 18*a*-18*d* depict the example binder apparatus of FIGS. 17*a*-17*d* with the example binder housing removed in different positions.
FIGS. 19*a* and 19*b* depict bottom views the example binder apparatus of FIGS. 18*a* and 18*b* with the example lever in different positions.
Figure 17D:
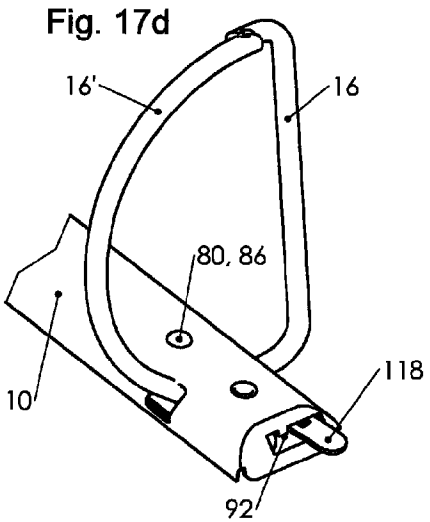
Figure 17C:
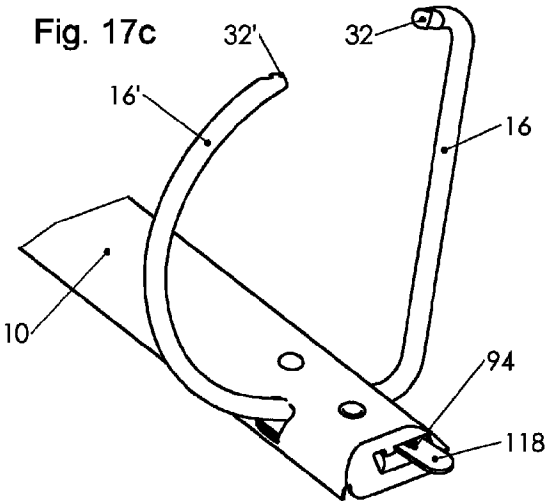
Figure 18D:
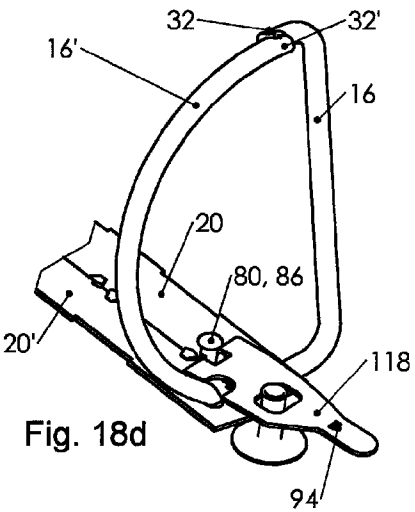
Figure 18C:
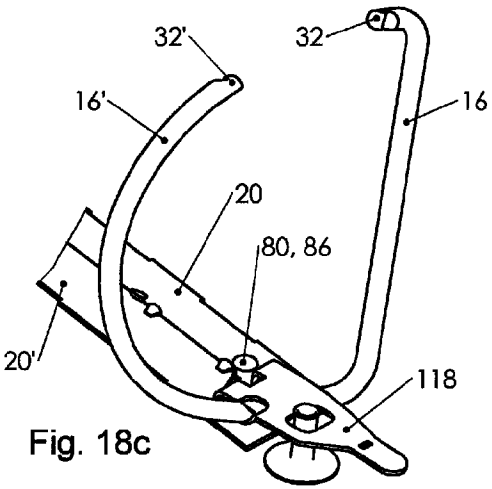
Figure 20A:
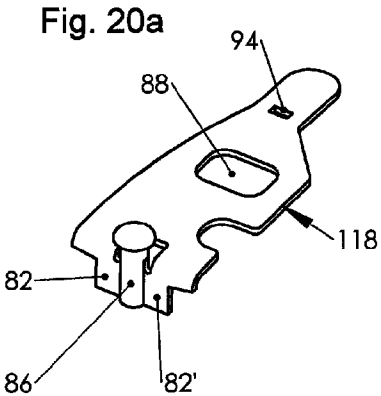
FIG. 20*a* depicts an example actuating lever of the example binder apparatus of FIGS. 17*a*-17*d*.
Figure 20B:
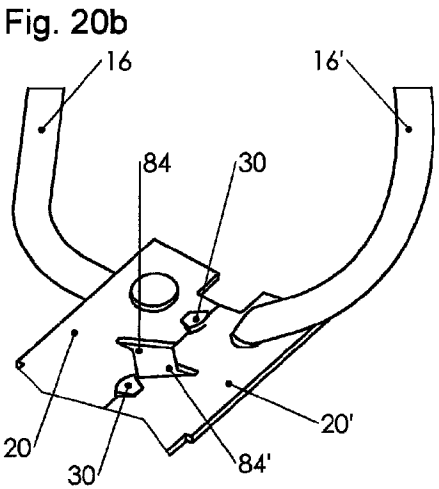
FIG. 20*b* depicts an end of example support rails of the example binder apparatus of FIGS. 17*a*-17*d* positioned opposite the example actuating lever

In some examples, the binder apparatus 1500 my include a rod or actuating member 74 to pivot the swivel portions 62 and the locking elements 32 and 32' between the closed, locking or overlapping position (see FIG. 16*a*) and the open, unlocked or exposed position (FIG. 16*b*). The lever 18 may be used to rotate the swivel portions 62 between the unlocked and locked positions (see FIGS. 16*a* and 16*b*). By further depressing and/or moving the lever 18, the opening arm or surface 54 of the lever 18 interacts with the support rails 20 and/or 20' to enable the support rails 20 and 20' to be pivoted about the pivot axis 22 while and/or after the swivel portions 62 are turned.

The example binder apparatus 1500 may be opened in a similar sequence as the example binder apparatus 1000. The binder apparatus 1500 may not include a closing arm or surface on the lever 18. As such, by pivoting the lever 18 to the upright or initial position, the half rings 16' are moved to be in line with and/or parallel to the corresponding half ring 16 to enable documents, etc. to be easily inserted and/or removed from the binder apparatus 1500. The binder apparatus 1500 may be closed by manually pressing one or more of the half rings 16 and/or 16' toward one another. The locking elements 32 and 32' may be secured in the overlapping position via the interaction between the locking elements 32 and 32' (see FIG. 16*a*).

The lever 18 may open the support rails 20 and 20' and/or pivot the swivel portions 62 to unlock the locking elements 32 and 32'. To close the binder apparatus 1500, the swivel portions 62 may be moved such that the half rings 16 and 16' are in line with one another and then one or more of the half rings 16 and 16' may be manually moved to close the binder apparatus 1500.

FIGS. 17*a*-20*b* depict another example binder apparatus 1700. The half rings 16 and 16' are coupled at their ends 19 and 19' to the respective support rails 20 and 20'. The half rings 16 and 16' may include the locking elements 32 and 32' that interlock and/or interact in the closed position to substantially prevent the binder apparatus 1700 from being inadvertently opened and/or to substantially prevent the support rails 20 and 20' from being pivoted about the pivot axis 22. To unlock the locking elements 32 and 32', an actuating member or lever 118 may be used to displace and/or move the support rails 20 and 20' in the counterclockwise direction relative to one another and the housing 10. The lever 118 may be an actuating lever that is moveable about and/or relative to a swivel axis 80 at a substantially right angle relative to the pivot axis 22 and substantially perpendicular to the central portion 11.

The lever 18 may include tabs 82 and 82' spaced and/or at a lateral distance from the pivot axis 22. The tabs 82 and 82' may be bent and/or extend toward the support rails 20 and 20' such that the tabs 82 and 82' are received in open-edge recesses and/or slots 84 and 84' of the support rails. The tabs 82 and 82' may be pivoted in a limited manner to displace and/or move the support rails 20 and 20' relative to one another.

In the example binder apparatus 1700, the lever 118 may be used to lock or unlock the half rings 16 and 16'. More specifically, the interaction between the tabs 82 and 82' and the support rails 20 and 20' displaces the support rails 20 and 20' and/or unlocks the locking elements 32 and 32' (see FIGS. 18*a*, 18*b*, 19*a*, 19*b*). Once the locking elements 32 and 32 are unlocked and/or exposed, the half rings 16 and 16' may be moved to the open position manually and/or by hand (see FIGS. 17*c*, 17*d*, 18*c* and 18*d*). Because of the interaction between the tabs 30 and the support rails 20 and 20', the binder apparatus 1700 may be opened by moving one of the half rings 16 and/or 16' and the other half rings 16 and/or 16' may be moved via the interaction with the respective support rail 20 and/or 20' (see FIG. 20*b*), for example.

A hinge pin or elongated member 86 may be positioned adjacent the swivel axis 80 of the lever 118. The hinge pin 86 may be rotated opposite and/or relative to the housing 10. The hinge pin 86 may receive and/or be coupled to the tabs 82 and 82' such that the tabs 82 and 82' radially protrude from the hinge pin 86.

An oblong hole or aperture 88 of the lever 118 may receive an elongated member 90 that may be coupled to the housing 10. The interaction between the elongated member 90 and the aperture 88 may limit the pivoting movement of the lever 118. When the binder apparatus 1700 is in the closed position, the lever 118 may be secured relative to the housing 10 (see FIG. 17*a*). To secure the lever 118 relative to the housing 10, the lever 118 may define a recess or aperture 94 that receives a snap-pin or extension 92 of the housing 10.

The examples described herein relate to file mechanism and/or apparatus for holding perforated items and/or documents. The binder apparatus includes the housing with spring elastic housing flanks 28 that may be bent, for example, upwards. The two support rails 20 and 20' may be positioned in the housing 10. The support rails 20 and 20' may be pivoted against one another about the inner longitudinal edges 24 relative to the pivot axis 22 in a toggle-like manner. The half rings 16 and 16' may be spaced along the support rails 20 and 20' and coupled thereto. The half rings 16 and 16 may be arranged such that, in the closed position, they engage and form ring pairs 14.

The locking elements 32 and 32' may interlock in the closed position to substantially secure the support rails 20 and 20' against pivoting about the pivot axis 22. At the beginning of the opening operation, the support rails 20 and 20' may be moved relative to one another between an overlapping position (e.g., the locking elements 32 and 32' engaging) and an exposed position (e.g., the locking elements 32 and 32' spaced from one another) to unlock the locking elements 32 and 32'. During the closing operation, at least one of the support rails 20' may be moved relative to the other support rail 20 between the exposed position (e.g., the locking elements 32 and 32' spaced from one another) and the overlapping position (e.g., the locking elements 32 and 32' engaging). In some examples, the second support rail 20' may be displaceable and/or moveable substantially parallel to the pivot axis 22 relative to the housing 10. In such examples, the first support rail 20 may be non-displaceable and/or substantially not longitudinally moveable relative to the housing 10.

The examples described herein relate to file mechanisms or binder apparatus that may be handled, opened and/or closed relatively easily and reliably.

The binder apparatus 100 may include the controller 34 that interacts with the support rails 20 and/or 20' to control the movement, displacement and/or pivoting of the support rails 20 and 20' relative to one another. The support rails 20 and/or 20' may be, at the end of the closing operation and/or at the beginning of the opening operation, pre-stressed via the spring 42 that urges the locking elements 32 and 32' toward the overlapping and/or locked position. The binder apparatus 100 may include the lever 18 having the opening arm 54 that interacts with the first support rail 20 as the binder apparatus 100 is opened. The wire 48 may couple the lever 18 and the second support rail 20' to enable the first support rail 20' to be longitudinally moved substantially parallel to the pivot axis 22. The support rails 20 and/or 20' may include the tabs 30 that interact to at least partially enable the support rails 20 and 20' to be pivotably coupled to one another. The opening arm 54 and the closing arm 56 may interact with one of the support rails 20 and the wire 48 may interact with the other support rail 20', for example.

The controller 34 enables the sequence of opening and/or closing the binder apparatus 100 to be controlled. The controller 34 may, in a first phase of the closing operation, release and/or enable the pivoting path of the support rails 20 and 20' about the pivot axis 22 and/or substantially limits or prevents parallel movement of the support rails 20 and/or 20' relative to the pivot axis 22 until the support rails 20 and 20', with the locking elements 32 and 32' in the exposed position, have reached the closed position. The controller 34 may, in a second phase of the closing operation, release and/or enable the movement path of the support rails 20 and/or 20' substantially parallel to the pivot axis 22 and/or substantially limits and/or blocks the support rails 20 and/or 20' from pivoting about the pivot axis 22 until the locking elements 32 and 32' are in the locked position. At the end of the closing operation, the locking elements 32 and 32' may overlap and/or interlock to substantially prevent the binder apparatus 100 from being inadvertently opened.

In the overlapping position, the corresponding half rings 16 and 16' including the locking elements 32 and 32' may be substantially flush with one another. In the overlapping position, the locking elements 32 and 32' may be secured and/or locked in the locked position or adjacent to the locked position.

In the exposed position, the corresponding half rings 16 and 16', including the locking elements 32 and 32', may be offset and/or twisted relative to one another in a longitudinal direction of the support rails 20 and 20'. In the exposed position, the locking elements 32 and 32' release the opening and closing path of the support rails 20 and 20' and the corresponding half rings 16 and 16'.

The controller 34 may, in a first phase of the opening operation, release and/or enable the support rails 20 and/or 20' to move substantially parallel to the pivot axis 22 and/or substantially limits and/or prevents the support rails 20 and/or 20' from pivoting about the pivot axis 22 until the locking elements 32 and 32' are spaced from one another and/or in the exposed position. The controller 34 may, in a second phase of the opening operation, release and/or enable the support rails 20 and/or 20' to pivot about the pivot axis 22 from the closed position to the open position and/or substantially limits and/or prevents the support rails 20 and/or 20' from moving substantially parallel to the pivot axis 22 and/or in the overlapping direction.

The lever 18 may include the closing arm 56 that interacts with one of the support rails 20 and/or 20' in the closing direction and/or as the binder apparatus 100 is closing. The opening and closing arms 54 and 56 of the lever 18 engage and/or interact with the first support rail 20. The lever 18 may also engage and/or interact with the second support rail 20'. The second support rail 20' may be moveable and/or displaceable substantially parallel to the pivot axis 22 and to the first support rail 20. The half rings 16 and 16' extend through the holes (e.g., 12, 12') of the housing 10. The apertures' 12 may be sized to correspond to the movement path of the second support rail 20' between the overlapped and exposed positions. The apertures 12' may be oblong holes.

The controller 34 may include the surfaces 36 and 38 that interact with the tab 40 positioned on and/or coupled to the second support rail 20' proximate the pivot axis 22. The controller 34 may be coupled to the housing 10 and/or to the first support rail 20. The tab 40 may engage and/or interact with the surfaces 36 and 38 and/or the controller 34. The tab 40 may be a bent portion of the second support rail 20', for example. The surfaces 36 and 38 may provide a movement path in which the tab 40 moves and controls the movement path and/or pivoting path of the support rails 20 and/or 20'.

The support rail 20 and 20' may include the tabs 30 adjacent the pivot axis 22 that overlap and/or engage the opposing support rail 20 and/or 20'. The opening arm 54 and the closing arm 56 may interact with one of the support rails 20 and the wire 48 may interact with the other support rail 20'. The lever 18 includes clearances to enable the lever 18 and/or the support rails 20 and/or 20' to be moved between the open and closed positions.

The second support rail 20' may be connected to the lever 18 and may be spring loaded and/or tensioned in the direction of opening the lever 18. The spring 42 may be coupled to the second support rail 20', the housing 10 and/or the controller 34.

The lever 18 may be swiveled around the axis 60 substantially parallel to the central portion 11 and at a substantially right angle relative to the pivot axis 22. The lever 18 may include the lever arm or portion 50 that is coupled to and/or interacts with the end 46 of the second support rail 20'. More specifically, the lever arm 50 may include the coupling area 44 that receives the end 46 at an angle of between about 80° and 100° with actuating clearance. The coupling area 44 may be a slot or recess, for example.

Alternatively, the actuating element 48 may be the wire 48 coupled between the lever arm 50 of the lever 18 and the second support rail 20' with actuating clearance. The wire 48 may include a bend or portion that is received in an aperture or bore of the lever 18 to couple the wire 48 thereto. The bend may be substantially parallel to the pivot axis 60. A tension spring may be integrated with the wire 48 and/or the lever 18.

In other examples, the lever 118 may be pivoted about the swivel axis 80 substantially perpendicular to the central portion 11 and at a substantially right angle relative to the pivot axis 22. The lever 118 may include the tabs 82 and 82' laterally spaced from the pivot axis 22 and at least partially positioned in the slots 84 and 84' of the support rails 20 and 20'. The tabs 82 and 82' may be pivoted relatively limitedly relative to the support rails 20 and 20', the half rings 16 and 16' and/or the locking elements 32 and 32'. The lever 118 may be secured relative to the housing 10 with the locking elements 32 and 32' in the overlapping and locked position and/or the exposed and unlocked position.

When closing the half rings 16 and 16' with the locking elements 32 and 32' exposed, the half rings 16 and 16' may be pivoted by hand or manually between the open and closed positions.

To reduce sliding friction between the support rails 20 and 20' in the displacement direction, one or more of the hinge elements 23' and/or 23" may be loosely inserted adjacent the pivot axis 22 between the support rails 20 and 20'. The hinge element 23' and/or 23" may receive at least a portion of the inner longitudinal edges 24. The hinge element 23' may be an elongated strip of molded elastomer material. Alternatively, the hinge element 23" may be a plurality of rolling bodies or groove portions made of a metal material.

The binder apparatus 500 and/or 700 may include the half rings 16 and 16' having the locking element 32 and 32' adjacent the pivot axis 22. The locking elements 32 and 32' may interact with one another in the closed position to substantially limit and/or prevent the support rails 20 and 20' from pivoting relative to the pivot axis 22. The swivel portion 62 may be movable in a limited manner relative to the first support rail 20 to move the locking elements 32 and 32' between the locking and overlapping position and the unlocked and exposed position. The locking elements 32 and 32' may be positioned on the ends of the half rings 16 and 16'. The swivel portion 62 of the second support rail 20' may be limitedly pivoted or moved relative to the first support rail 20.

The binder apparatus 700 includes a plurality of swivel portions 62 positioned adjacent one another. One of the half rings 16' is coupled to the respective swivel portions 62. The half rings 16' are rotatable and/or moveable relative to the opposing half rings 16 and/or the first support rail 20. The second support rail 20' may include the support rail portion 64 and the swivel portion(s) 62 that may be rotatable relative to the first support rail 20. The second support rail 20' may include the half rings 16' and the first support rail 20 may include the half rings 16.

The lever 18 may include the opening arm 54 that interacts with and/or engages the first support rail 20 in the opening direction. The lever 18 may also include the actuating element 68 that engages and/or couples with the second support rail 20'. There may be a motion of clearance provided between the actuating element 68 and the opening arm 54. The actuating element 68 may be a pull rod suspended between a lever arm or portion 70 of the lever 18 and the swivel portion 62 with at least some actuating clearance.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A binder apparatus, comprising:

a housing;

a first support rail positioned within the housing;

a second support rail positioned within the housing, wherein during a first phase the first support rail is longitudinally moveable relative to the second support rail and wherein during a second phase the respective support rails are pivotable relative to one another;

a controller coupled to at least one of the housing or the second support rail and spaced from an end of the housing, the controller comprising an opening to face the end of the housing, the controller comprising surfaces that interact with at least one of the first support rail or the second support rail to control the movement of the support rails during the first and second phases; and first and second closure members coupled to the respective support rails, wherein the closure members are positioned on the respective support rails to enable the closure members to engage when the binder apparatus is in a closed position an actuating element coupled between a lever and the first support rail to longitudinally move the first support rail relative to the second support rail.

2. The binder apparatus of claim 1, further comprising locking elements coupled at ends of the closure members, wherein when the binder apparatus is in the closed position, the locking elements are in an interlocked position to substantially prevent the first support rail from pivoting relative to the second support rail.

3. The binder apparatus of claim 2, wherein to move the locking elements from the interlocked position and enable the binder apparatus to be moved from the closed position to an open position, the first support rail is longitudinally moved relative to the second support rail.

4. The binder apparatus of claim 2, further comprising a biasing element to bias the locking elements toward the interlocked position.

5. The binder apparatus of claim 2, wherein in the first phase, the controller substantially prevents the respective support rails from pivoting relative to one another to enable the locking elements to move from the interlocked position.

6. The binder apparatus of claim 2, wherein in the second phase, the controller substantially prevents the first support rail from longitudinally moving relative to the second support rail to enable the locking elements to be in an unlocked position.

7. The binder apparatus of claim 1, wherein the lever is to open the binder apparatus, the lever to interact with the first support rail to longitudinally move the first support rail relative to the second support rail and to interact with at least one of the first support rail or the second support rail to pivot the support rails.

8. The binder apparatus of claim 7, wherein the lever interacts with at least one of the first support rail or the second support rail to move the support rails to at least one of an open position or the closed position.

9. The binder apparatus of claim 7, wherein the lever is pivotable about an axis positioned substantially parallel to a central portion of the housing and at a substantially right angle to a pivot axis adjacent inner longitudinal edges of the support rails.

10. The binder apparatus of claim 7, wherein the lever defines a groove to receive an end of the first support rail.

11. The binder apparatus of claim 10, wherein the end engages within the groove at an angle of between about 80 degrees and 100 degrees with an actuating clearance.

12. The binder apparatus of claim 1, further comprising one or more hinge elements positioned between the support rails.

13. The binder apparatus of claim 12, wherein the one or more hinge elements comprise an elastomer or metal material.

14. The binder apparatus of claim 1, wherein the actuating element is integrally coupled to the lever.

15. The binder apparatus of claim 1, wherein the actuating element is integral to the lever.

16. The binder apparatus of claim 1, wherein the actuating element is integral to the first support rail.

17. A binder apparatus, comprising:

a housing;

a first support rail positioned within the housing;

a second support rail positioned within the housing, wherein during a first phase the first support rail is longitudinally moveable relative to the second support rail and wherein during a second phase inner longitudinal edges of the respective support rails are pivotable relative to one another;

a controller coupled to at least one of the housing or the second support rail, the controller comprising surfaces that interact with at least one of the first support rail or the second support rail to control the movement of the support rails during the first and second phases;

first and second closure members coupled to the respective support rails, wherein the closure members are positioned on the respective support rails to enable the closure members to engage when the binder apparatus is in a closed position;

a lever to open the binder apparatus, the lever to interact with the first support rail to longitudinally move the first support rail relative to the second support rail and to interact with at least one of the first support rail or the second support rail to pivot the support rails about the inner longitudinal edges; and an actuating element coupled between the lever and the first support rail to longitudinally move the first support rail relative to the second support rail.

18. The binder apparatus of claim 17, wherein the actuating element is biased by a biasing element.

19. The binder apparatus of claim 17, wherein the actuating element comprises a rod or rail coupled to a lever arm of the lever and the first support rail with actuating clearance.

* * * * *